US010368624B2

(12) United States Patent
Thomason et al.

(10) Patent No.: US 10,368,624 B2
(45) Date of Patent: Aug. 6, 2019

(54) VACUUM ASSISTED SYSTEMS AND METHODS FOR GROOMING HAIR

(71) Applicant: RevAir, LLC, Macedonia, OH (US)

(72) Inventors: Scott Thomason, Macedonia, OH (US); Foster Cooper, Lake Worth, FL (US); Debra Isaacson, London (GB)

(73) Assignee: REVAIR, LLC, Solon, OH (US)

( * ) Notice: Subject to any disclaimer, the term of this patent is extended or adjusted under 35 U.S.C. 154(b) by 0 days.

(21) Appl. No.: 15/657,833

(22) Filed: Jul. 24, 2017

(65) Prior Publication Data

US 2017/0318934 A1 Nov. 9, 2017

Related U.S. Application Data

(63) Continuation of application No. 14/957,522, filed on Dec. 2, 2015, now Pat. No. 9,713,370.

(60) Provisional application No. 62/123,912, filed on Dec. 2, 2014.

(51) Int. Cl.
*A45D 20/00* (2006.01)
*A45D 20/12* (2006.01)

(52) U.S. Cl.
CPC ..... *A45D 20/00* (2013.01); *A45D 20/12* (2013.01)

(58) Field of Classification Search
CPC ..... A45D 20/12; A45D 20/00
USPC ..... 34/97, 283
See application file for complete search history.

(56) References Cited

U.S. PATENT DOCUMENTS

| | | | |
|---|---|---|---|
| 2,654,161 | A | 10/1953 | Bowen |
| 3,213,859 | A | 10/1965 | Mizell et al. |
| 3,444,624 | A | 5/1969 | Greenlee |
| 4,210,162 | A | 7/1980 | Dreyer et al. |
| 4,254,324 | A | 3/1981 | Vrtaric |
| 4,409,998 | A | 10/1983 | Bauer |
| 4,422,464 | A | 12/1983 | Josefsson |
| 4,706,326 | A | 11/1987 | Romani |
| 5,142,786 | A | 9/1992 | Hunts |
| 5,228,431 | A | 7/1993 | Giarretto |
| 5,269,073 | A | 12/1993 | Johnson |

(Continued)

FOREIGN PATENT DOCUMENTS

| | | | |
|---|---|---|---|
| CN | 204467284 | U | 7/2015 |
| EP | 0107748 | A1 | 5/1984 |

(Continued)

*Primary Examiner* — Stephen M Gravini
(74) *Attorney, Agent, or Firm* — Benesch, Friedlander, Coplan & Aronoff LLP

(57) ABSTRACT

A hair grooming apparatus includes a vacuum mechanism and a vacuum chamber that is in fluid communication with the vacuum mechanism. The vacuum chamber includes a first opening positioned at a first end of the vacuum chamber with a first cross-sectional area and arranged to accommodate an insertion of a section of hair and a second opening positioned at a second and opposite end of the vacuum chamber. The vacuum chamber further includes a wall extending between the first and second openings and defining an interior bore. An air pocket is formed along a section of the interior bore extending from a first location located proximate to the first opening with a second cross-sectional area to a second location positioned between the first location and the second opening with a third cross-sectional area. The second cross-sectional area is greater than both the first cross-sectional area and the third cross-sectional area.

30 Claims, 21 Drawing Sheets

(56) References Cited

U.S. PATENT DOCUMENTS

| | | | | |
|---|---|---|---|---|
| 5,435,327 | A | 7/1995 | Ho | |
| 5,444,215 | A | 8/1995 | Bauer | |
| 5,790,749 | A | 8/1998 | Polaert et al. | |
| 6,925,728 | B2 | 8/2005 | Busa et al. | |
| 7,093,376 | B2 | 8/2006 | Regen | |
| 8,028,437 | B2 | 10/2011 | Brown-Carter | |
| 8,132,571 | B1 | 3/2012 | Jackson | |
| 8,230,819 | B2 | 7/2012 | Freidell | |
| 7,093,376 | C1 | 10/2013 | Regen | |
| 8,607,804 | B2 | 12/2013 | De Benedictis | |
| 8,887,738 | B2 | 11/2014 | Ward | |
| 8,959,788 | B2 | 2/2015 | Hada | |
| 9,713,370 | B2 * | 7/2017 | Thomason | A45D 20/12 |
| 2013/0233336 | A1 | 9/2013 | Lazzaro et al. | |
| 2015/0250141 | A1 * | 9/2015 | Ferrentino | A47L 9/06 119/610 |

FOREIGN PATENT DOCUMENTS

| | | | |
|---|---|---|---|
| WO | 2008047120 | A1 | 4/2008 |
| WO | 2013158626 | A1 | 10/2013 |
| WO | 2014064520 | A1 | 5/2014 |

* cited by examiner

VACUUM ASSISTED SYSTEMS AND METHODS FOR GROOMING HAIR

CROSS-REFERENCE TO RELATED APPLICATIONS

This application claims priority to pending U.S. patent application Ser. No. 14/957,522, titled "Vacuum Assisted Hair Drying/Styling Device" and filed on Dec. 2, 2015, which claims priority to U.S. Provisional Patent Application Ser. No. 62/123,912, titled "Vacuum Assisted Hair Drying/Styling Device" and filed on Dec. 2, 2014, both of which are expressly incorporated by reference herein in its entirety.

FIELD OF INVENTION

The present application is directed to systems, apparatus, and methods for grooming hair, and more specifically, the present application is directed to systems, apparatus, and methods for drying, styling, and cleaning hair using a suction force created by a vacuum.

BACKGROUND

The grooming of human hair is a common and important activity. Typical routines for grooming hair include washing, drying, and styling of hair. Such routines are especially common for individuals with relatively long hair. It is common for an individual to wash hair via a shampooing process and subsequently dry the hair using a conventional blow dryer. Although, blow-drying of human hair has been a common practice for decades, blow-drying often causes damage to the physical structure of human hair. Hair is a fibrous filament made of protein and each strand of hair is comprised of three layers—a medulla, the inner layer; the cortex, the middle layer; and the cuticle, the outer layer. The medulla is a generally unstructured region at the center of a strand of hair. The cortex surrounds the medulla and is an important layer because it provides each strand of hair with its mechanical strength and absorbs moisture, which is needed for healthy hair. The cortex also includes melanin, which determines the color of hair. The general shape of the cortex contributes to the general shape of strands of hair, i.e., whether hair is straight, wavy, or curly. The cuticle protects the medulla and cortex from the environment. Because the medulla and cortex are sensitive to damage the cuticle has an important role in maintaining the health of each strand of hair.

The cuticle is comprised of a series of cells that generally lay one after the other down the length of each strand of hair from the root of the strand to the exposed end of the strand. Such cells work in cooperation to prevent damage to the inner structures of hair and to maintain and control the water content of each strand of hair. When a conventional blow-dryer is used to dry hair, hot air directed at the hair can cause the cells of the cuticle to open outward, which can expose the cortex to the hot air. Such exposure can damage the cortex by breaking down its structure and removing the moisture stored in the cortex that is necessary for healthy hair. Such damage often results in hair acquiring a dry and lackluster appearance and retaining static charge, which can cause an unwelcome appearance often referred to as "frizzy" hair.

Additionally, people often desire hair that is straight and has a sleek finish. To achieve such an appearance, people often apply heated flat iron straighteners to already dried hair. However, the application of heat can cause temporary changes in the structure of the hair, including altering hydrogen bonds that structurally support a strand of hair. Such changes in structure can weaken hair, result in a dull appearance, and, over time, such temporary changes can result in permanent damage to the strands of hair.

Alternatively, when the goal is to achieve curly or wavy hair, it is common to use a blow-dryer along with any number of styling devices to blow dry curls or waves into wet hair. Such methods include directing the flow of hot air at hair from a variety of angles while manipulating the hair into various arrangements. Such treatment often results in damage to the styled hair. There are also many types of heated styling tools including curling rods and irons that are commonly used on dry hair. However, these methods can also cause damage as hair is put in direct contact with heating elements, which intensify the heat that is applied to each strand of hair.

There is a need in the hair grooming industry for systems, apparatus, and methods for grooming hair that are less damaging, faster, easier, and more effective than traditional methods of grooming hair.

SUMMARY

In one embodiment disclosed herein, a hair grooming apparatus includes a vacuum mechanism and a vacuum chamber. The vacuum chamber is in fluid communication with the vacuum mechanism. The vacuum chamber includes a first opening positioned at a first end of the vacuum chamber with a first cross-sectional area and arranged to accommodate an insertion of a section of hair and a second opening positioned at a second end of the vacuum chamber opposite the first end of the vacuum chamber. The vacuum chamber further includes a wall extending from the first opening to the second opening and defining an interior bore. An air pocket is formed along a section of the interior bore extending from a first location positioned proximate to the first opening and having a second cross-sectional area to a second location positioned between the first location and the second opening and having a third cross-sectional area. The second cross-sectional area is greater than both the first cross-sectional area and the third cross-sectional area.

BRIEF DESCRIPTION OF THE DRAWINGS

In the accompanying drawings, structures are illustrated that, together with the detailed description provided below, describe example embodiments of the claimed invention. Where appropriate, like elements are identified with the same or similar reference numerals. Elements shown as a single component may be replaced with multiple components. Elements shown as multiple components may be replaced with a single component. The drawings may not be to scale. The proportion of certain elements may be exaggerated for the purpose of illustration.

DETAILED DESCRIPTION

Figure 1:
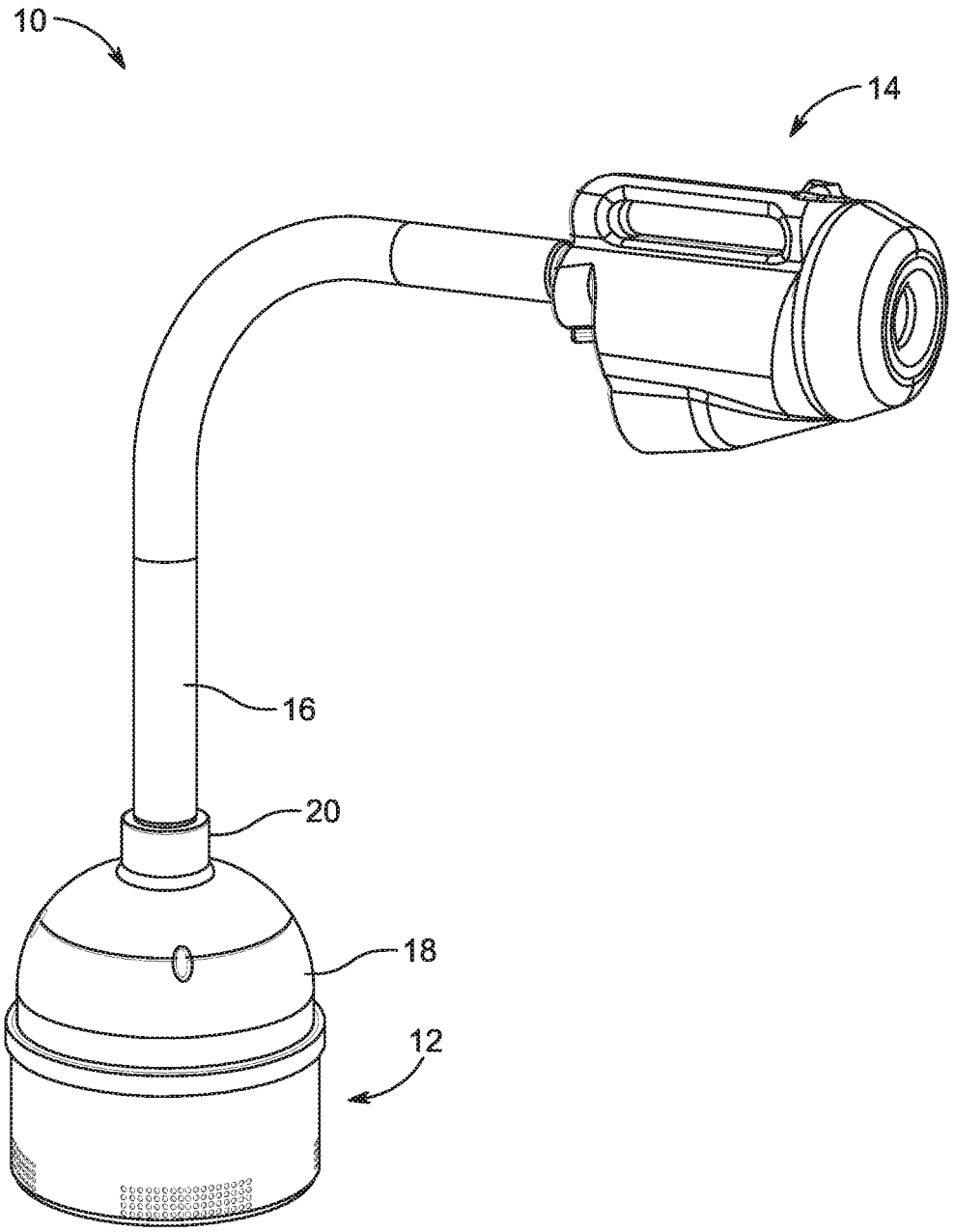
FIG. 1 is a schematic illustration depicting a front perspective view of a hair grooming system as disclosed herein.

The systems, arrangements, and methods disclosed in this document are described in detail by way of examples and with reference to the figures. It will be appreciated that modifications to disclosed and described examples, arrangements, configurations, components, elements, apparatus, methods, materials, etc. can be made and may be desired for a specific application. In this disclosure, any identification of specific techniques, arrangements, methods etc. are either related to a specific example presented or are merely a general description of such a technique, arrangement, method, etc. Identifications of specific details or examples are not intended to be and should not be construed as mandatory or limiting unless specifically designated as such. Selected examples of systems, apparatus, and methods for grooming hair using suction forces generated by a vacuum are hereinafter disclosed and described in detail with reference made to FIGS. 1-28.

Generally, systems, apparatus, and methods described and disclosed herein are directed to grooming of human hair. Grooming of hair can include activities such as drying wet hair; styling wet or dry hair, i.e., smoothing, straightening, curling, waving, etc.; cleaning wet or dry hair; or combinations thereof. Disclosed embodiments of systems, apparatus, and methods can cause ambient or heated air to flow over hair to groom the hair. In particular, the disclosed embodiments can generate a vacuum to facilitate the flow of ambient or heated hair over hair to groom the hair. The direction of the flow of ambient or heated air can be controlled by the systems, apparatus, and methods disclosed. For example, the flow of air can be along the length of the hair in a direction from the root of the hair to the free end of the hair. Furthermore, the shape and arrangements of surfaces that come into contact with hair during grooming can affect the shape of groomed hair. Therefore, disclosed systems, apparatus, and methods can utilize the power of suction created by a vacuum combined with heat and shaped contact surfaces to groom hair.

In one embodiment, a system generates a vacuum that draws or pulls hair into a vacuum chamber. The air flow caused by the vacuum causes air to flow over the hair in a direction from the root of the hair to the free end of the hair, which can remove excess water from the hair. Selectively, hot or warm air can be introduced into the vacuum chamber to assist in the drying process. The suction effect of the vacuum forces air in a direction along the length of the hair that encourages cells of the cuticle layer of hair to lay down flat in their natural arrangement, thus, resulting in healthy, sleek-appearing hair. Furthermore, such methods can conclude with forcing ambient (i.e., unheated) air over the hair in order to preserve and enhance the moisture content of the cortex layer of the hair.

In certain embodiments, a portion of a system or apparatus can include components that move and heat air that is useful in grooming hair. For example, an integrated fan can move air through or across heating elements and into a vacuum chamber or in and around the vacuum chamber opening. Such heated air can interact with hair to facilitate drying, styling, or otherwise grooming of hair. Alternatively, the walls of the vacuum chamber can be heated using conduction, which can warm and dry hair. The vacuum chamber can be adjusted to various shapes to achieve varying effects on hair. In one example, the cross-sectional area of the vacuum chamber can be increased or decreased in order to control the velocity of air flowing through the vacuum chamber. Such increases and decreases in cross-sectional area can be implemented in a single vacuum chamber such that the velocity of air flowing through the vacuum chamber can vary along the length of the vacuum chamber. In other examples, the shape of the vacuum chamber can influence the shape of groomed hair. A straight vacuum chamber can be used to achieve finished straight hair. A slight or gradual bend or multiple such bends in the vacuum chamber can be used to achieve finished wavy hair. A tight bend or multiple tight bends in the vacuum chamber can be used to achieved finished curly hair.

In addition to drying and styling hair, disclosed systems, apparatus, and methods can further be used to cleanse hair. In one example, the suction force applied to dry hair can vacuum away dust and dirt accumulated within or on the hair between shampoos. Further, systems, apparatus, and methods can be used in conjunction with existing dry shampoo products to "dry clean" hair. Dry shampoos, having become increasingly popular in recent years as a means of cutting down shampooing and drying occurrences, are arranged to absorb excess oils produced by the sebaceous glands on the scalp and deposited on strands of hair. The dry shampoo, commonly sprayed on as a powder, is normally arranged to be brushed away from the hair. However, systems, apparatus, and methods disclosed herein can more effectively vacuum the dry shampoo away from the scalp, while at the same time cleaning the hair down the length of each strand of hair.

Figure 2:
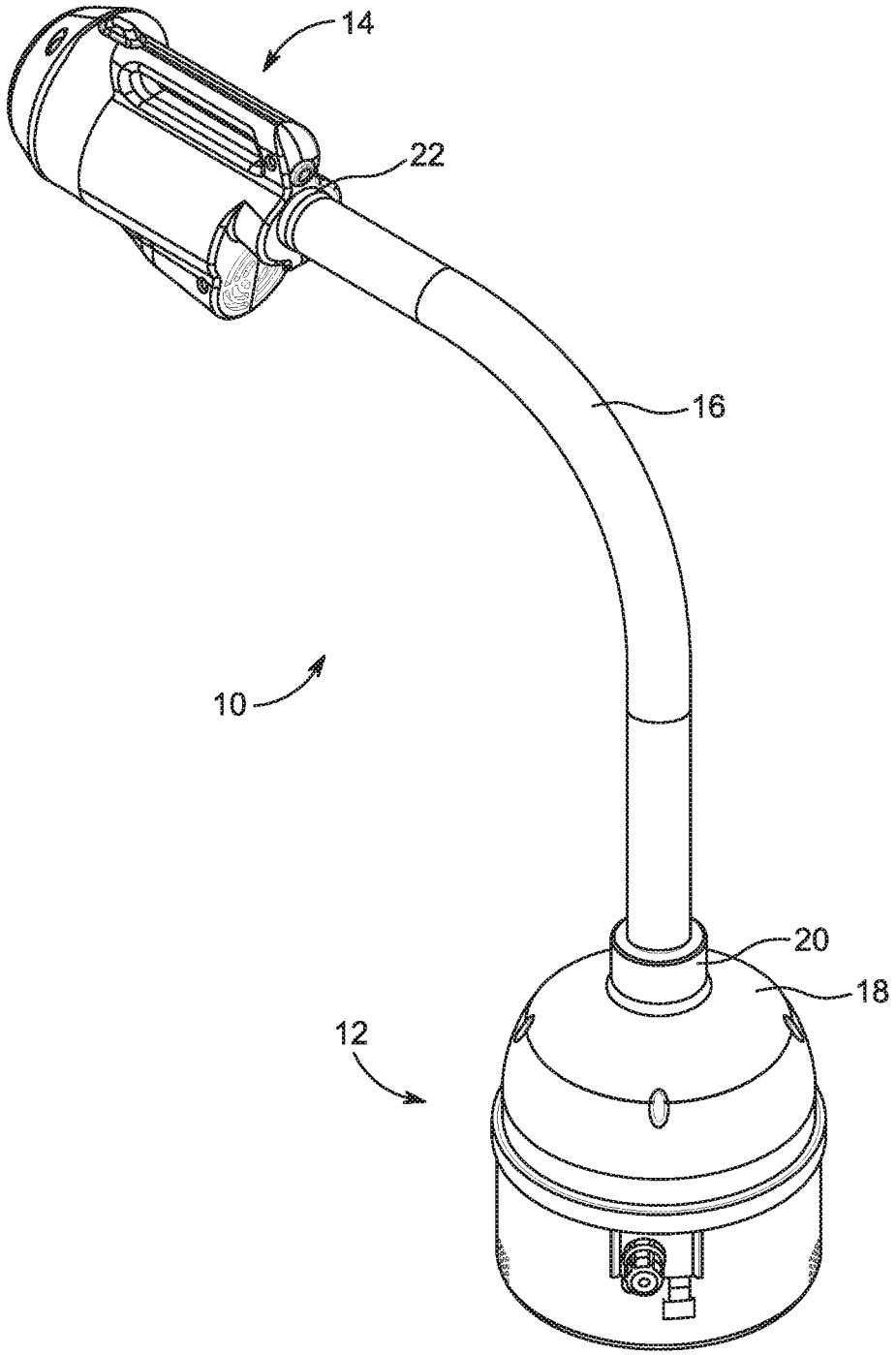
FIG. 2 is a schematic illustration depicting a rear perspective view of the hair grooming system of FIG. 1.

One exemplary embodiment of a hair grooming system 10 is illustrated in FIGS. 1 and 2. The system 10 comprises a vacuum canister 12, hand-held unit 14, and a hose 16 connection the vacuum canister 12 and hand-held unit 14. As will be fully described here, the vacuum canister 12 is arranged to generate a vacuum, the hand-held unit 14 is arranged to engage and interact with hair to groom the hair, and the hose 16 is arranged to form a path for fluid, such as ambient or heated air, to flow between the hand-held unit 14 and vacuum canister 12. The hose 16 can be a flexible, light-weight hose, where the length of the hose 16 is selected to accommodate the movement of the hand-held unit 14 by a user of the system 10 to groom the user's hair or another person's hair.

The vacuum canister 12 can include an outer housing 18 and a coupling 20 arranged to engage and secure one end of the hose 16 to the vacuum canister 12. A vacuum mechanism located within the outer housing 18 generates the vacuum forces required to cause air to flow through the hand-held unit 14 and the hose 16, and into the vacuum canister 12. In one embodiment, the vacuum mechanism can be a positive displacement pump. For example, the vacuum mechanism can use a rotary vane pump or a piston driven pump that creates a vacuum. In another embodiment, the vacuum mechanism can be an aspirator-type pump, i.e., a Venturi vacuum pump. As best illustrated in FIG. 2, a coupling 22 can be included that is positioned around one end of the hose 16 and arranged to engage and secure that end of the hose 16 to the hand-held unit 14. A power cord (not shown) running from the vacuum canister 12 to the hand-held unit 14 can be included to provide power to various mechanisms in the hand-held unit 14. The power cord can be integrated into the hose and hidden from view. When the power cord is integrated with the hose, the ends of the hose can be arranged in part as electrical connectors that mate with compatible electrical connectors positioned on or within the hand-held unit and vacuum canister. This is to say, when the hose is connected to the hand-held unit and the vacuum canister and respective electrical connectors mate, electrical power can run through the power cord from the vacuum canister to the hand-held unit and vice versa. To enhance safety, momentary switches can be integrated into the electrical connects such that no electrical power is transmitted unless the hose is properly connected to the hand-held unit and vacuum canister. The proper engagement of the hose with the hand-held unit and vacuum canister can depress the momentary switch, which will allow electrical power to be transmitted.

Figure 3:
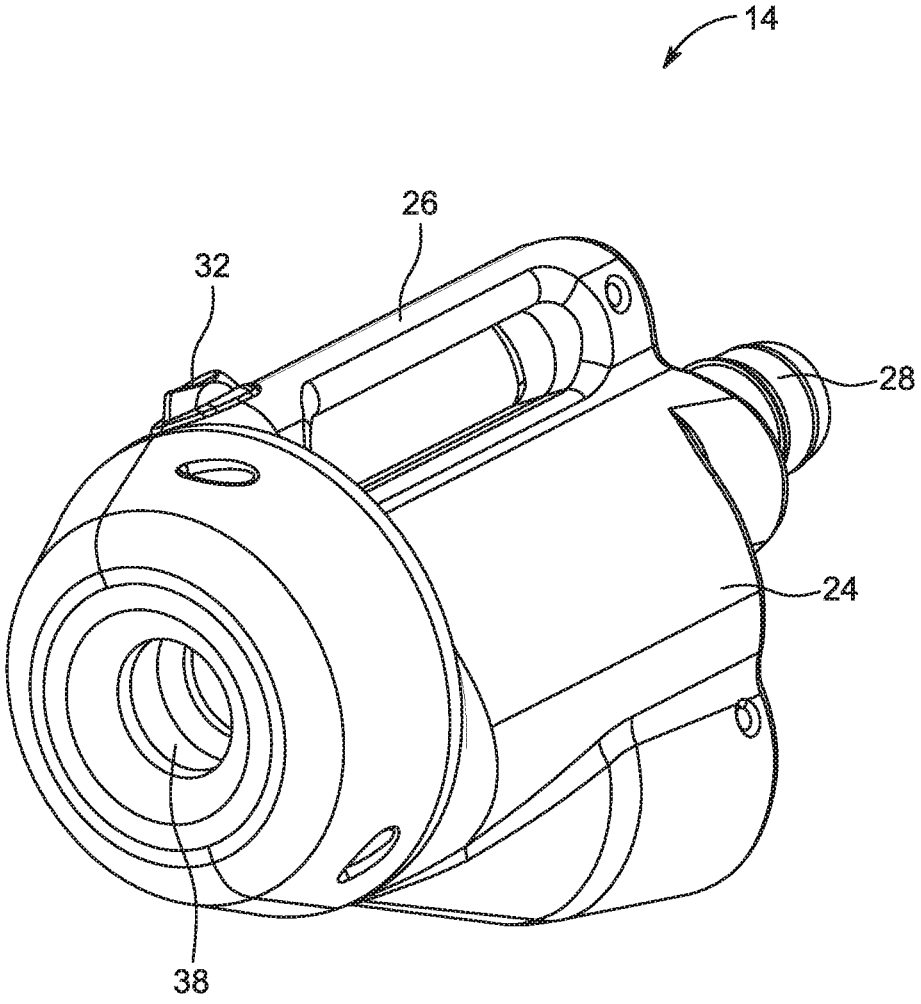
FIG. 3 is a schematic illustration depicting a front perspective view of the hand-held unit of the hair grooming system of FIG. 1.
Figure 4:
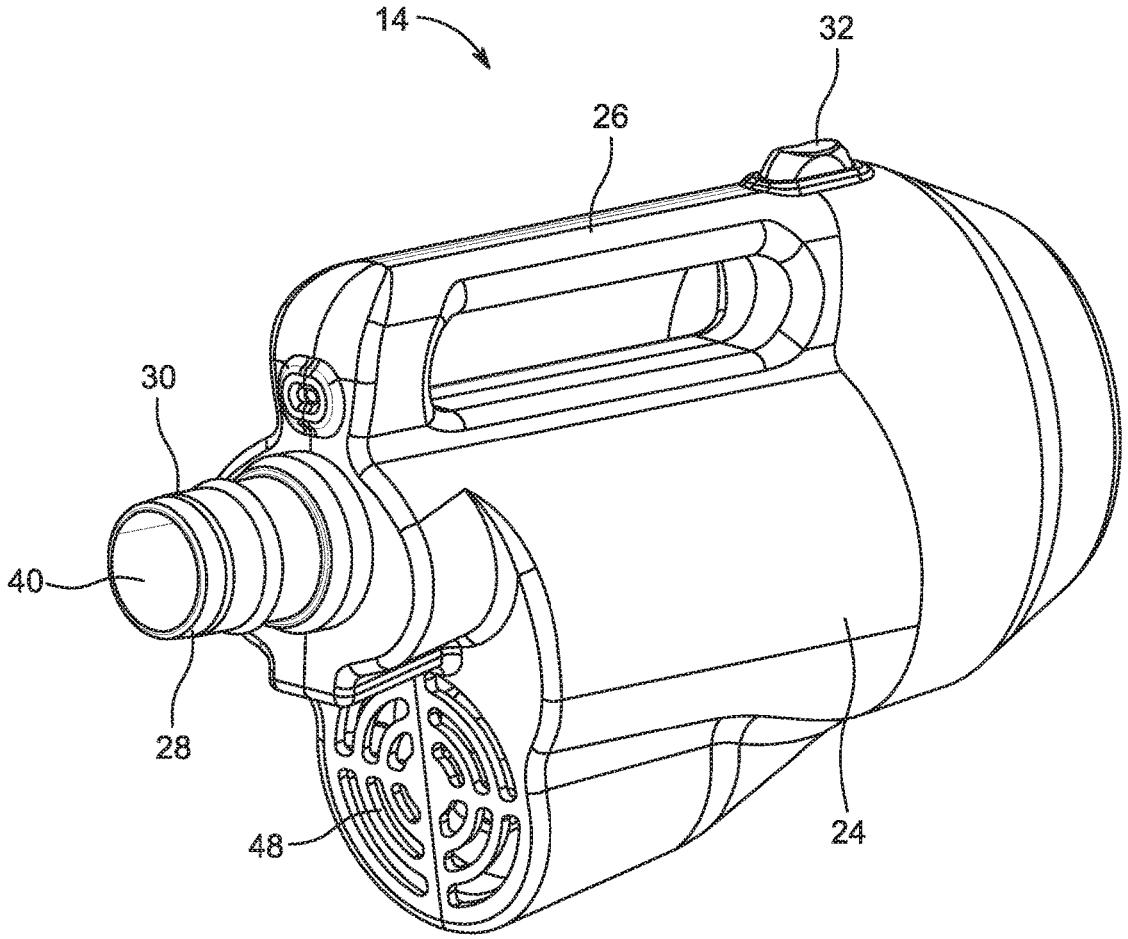
FIG. 4 is a schematic illustration depicting a rear perspective view of the hand-held unit of the hair grooming system of FIG. 1.
Figure 5:
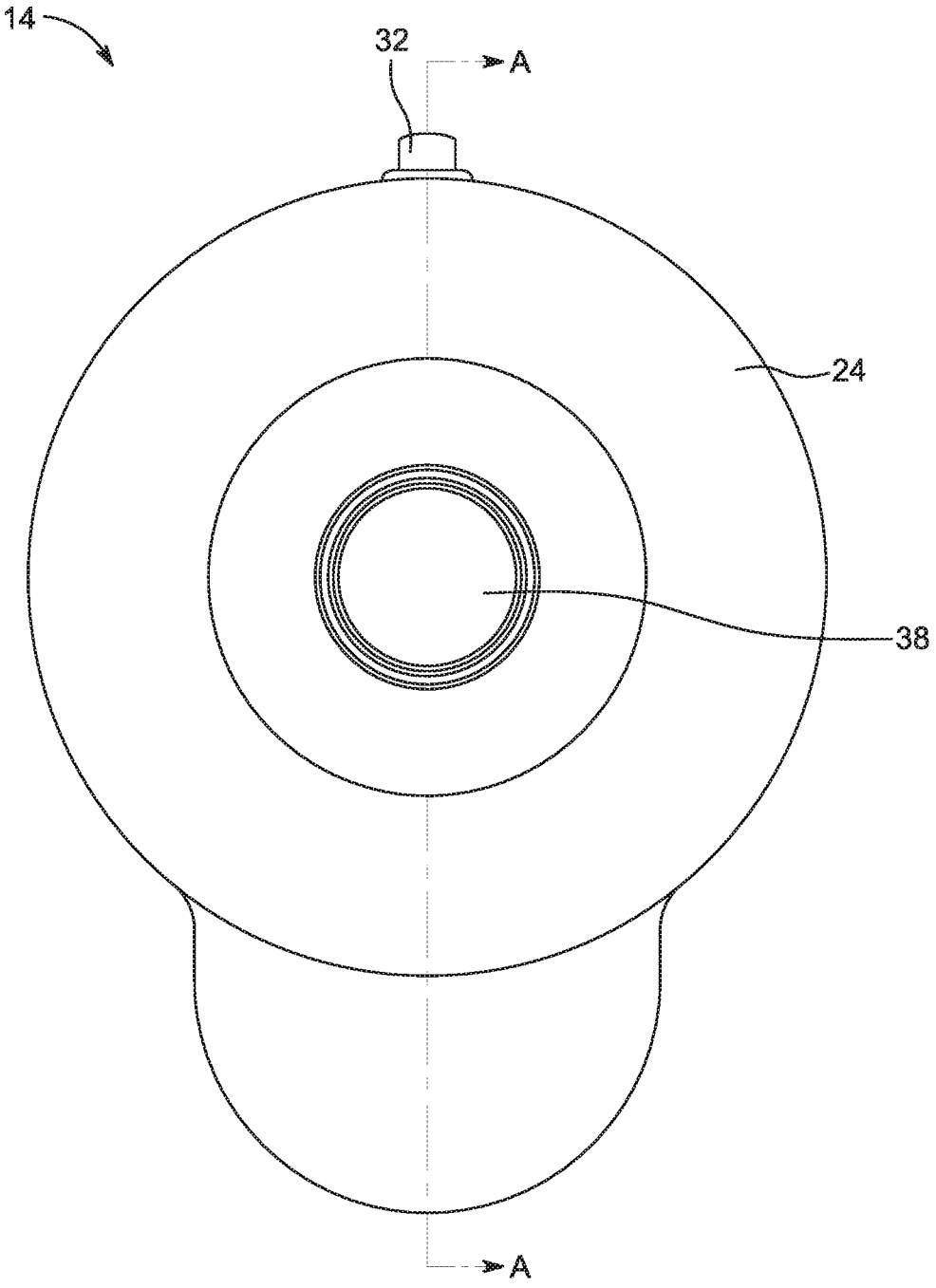
FIG. 5 is a schematic illustration depicting a front elevation view of the hand-held unit of the hair grooming system of FIG. 1.
Figure 6:
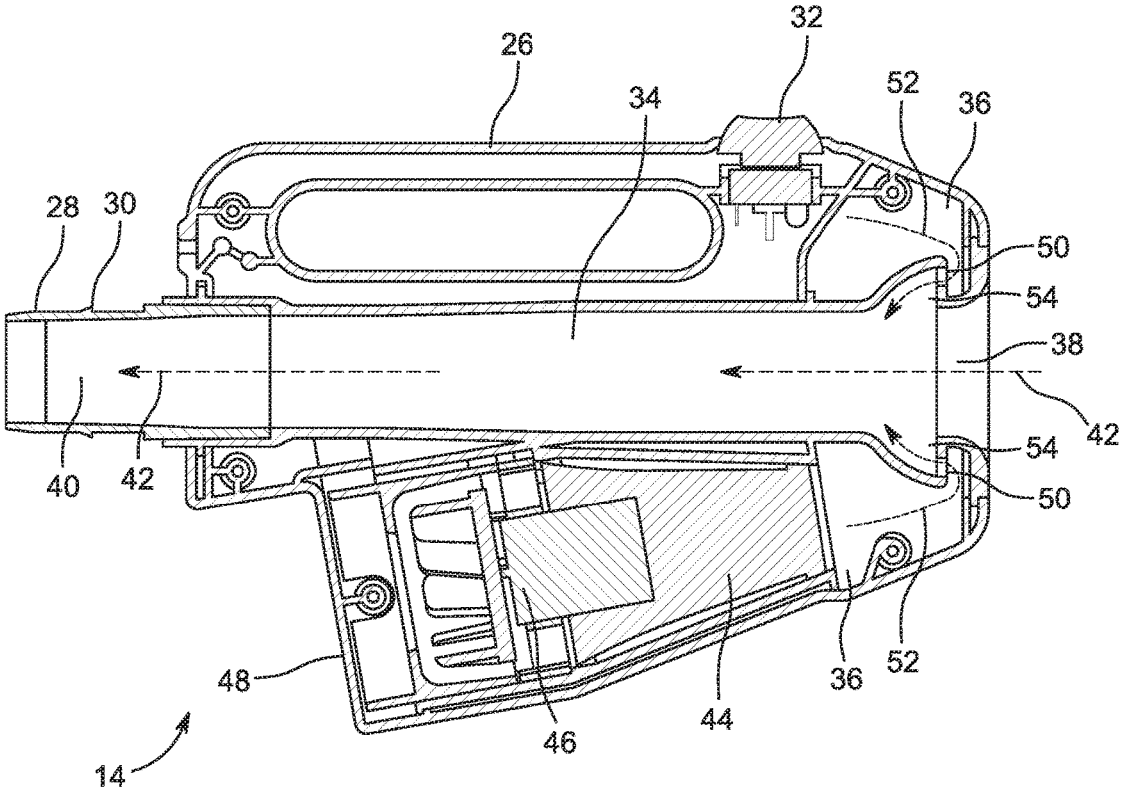
FIG. 6 is a schematic illustration depicting a cross-sectional view of the hand-held unit of the hair grooming system taken along the line A-A of FIG. 5.

FIGS. 3-6 illustrate in detail the exemplary hand-held unit 14 shown with the hair grooming system 10 of FIGS. 1 and 2. FIGS. 3 and 4 are perspective views of the hand-held unit 14, FIG. 5 is a front elevation view, and FIG. 6 is a cross-sectional view taken along the line A-A in FIG. 5. The hand-held unit 14 includes an outer housing 24, a handle 26, and a hose connector 28. The outer housing 24 can be arranged to form the outside contours of the hand-held unit 14, but also arranged to form one or more internal chambers within the hand-held unit as further described herein. The outer housing 24 can be molded or otherwise manufactured as a single component. Alternatively, the outer housing 24 can be comprised of two or more components assembled into the outer housing 24.

The handle 26 can be arranged such that a user of the system 10 can grasp the handle 26 and manipulate the hand-held unit 14 to facilitate the grooming of hair. The hose connector 28 is arranged to engage and secure one end of the hose 16 to the hand-held unit 14. Typically, the hose 16 is slid over the hose connector 28 to secure the hose 16 to the hand-held unit 14. As best illustrated in FIG. 4, the hose connector 28 can include one or more features 30 such as a ridge or barb that can engage the hose 16 once the hose 16 is slid over the hose connector 28. It will be understood that the hose connector 28 and coupling 22 can act cooperatively to secure the hose 16 to the hand-held unit 14. The handle 26 and hose connector 28 can be integrated into the design of the outer housing 24 such that all three components are molded or otherwise manufactured together. Alternatively, the handle 26 and/or the hose connector 28 can be separately molded or otherwise manufactured and subsequently assembled with the outer housing 24.

The hand-held unit 14 can further include a power switch 32. The power switch 32 can work cooperatively with the power cord to selectively provide electrical power to mechanisms and/or subsystems incorporated into the hand-held unit 14. The power switch 32 can be conveniently placed on the hand-held unit 14 to facilitate a user of the system 10 turning the system 10 on and off. It will be understood that although the power switch 32 is illustrated as located on the hand-held unit 14, a power switch can be located at other locations on the system 10 such as, for example, on the vacuum canister 12. Additionally, although a single power switch is illustrated, it will be understood that a hair grooming system can include two or more power switches to facilitate turning on and off various functions and subsystems of the hair grooming system.

FIG. 6 illustrates the internal configuration of the exemplary hand-held unit 14. The hand-held unit 14 can include a vacuum chamber 34 and a heated air chamber 36. The heated air chamber 36 can be arranged to partially surround the vacuum chamber 34. The shape of the vacuum chamber 34 as illustrated is generally circular in cross-section. As will be discussed further, the cross-sectional shape of a vacuum chamber can vary from one embodiment to another embodiment.

The vacuum chamber 34 includes a hair receiving aperture 38 and an exit aperture 40. The vacuum chamber 34 is in fluid communication with the vacuum canister 12 via the hose 16. It will be understood that upon the initiation of the vacuum mechanism, a suction force is asserted from the vacuum canister 12 through the hose 16 and into the vacuum chamber 34. Such a suction force will cause ambient air to enter the hair receiving aperture 38, pass through the vacuum chamber 34, pass through the exit aperture 40, through the hose 16, and into the vacuum canister 12. This is to say, when the vacuum mechanism is initiated, air will flow through vacuum chamber 34 in the direction illustrated by flow lines 42 of FIG. 6, from the hair receiving aperture 38 towards the exit aperture 40. A screen or other such filter can be optionally positioned in the exit aperture 40 to capture strands of hair and other materials that enter the vacuum chamber 34. As will be fully described herein, the user of the system 10 can insert sections of hair through the hair receiving aperture 38 and the section of hair move down into the vacuum chamber 34 due to the suction forces created by the vacuum.

Positioned within the heated air chamber 36 of the hand-held unit 14 is a heating element 44 and a fan 46. Positioned proximate to the fan 46 is an air intake section 48 that includes a plurality of openings in the outer housing 24 (as best illustrated in FIG. 4) to provide the fan 46 with access to ambient air. As illustrated in FIG. 4, the plurality of openings in the air intake section 48 can be generally slot shaped. It will be understood that such an arrangement can act as a screen to allow ambient air to enter the heated air chamber 36, while capturing or otherwise preventing debris from entering the heated air chamber 36. A screen or other similar component can be positioned at the air intake section 48 to further capture debris such as dust and other such particles. A plurality of air ports 50 are positioned between the heated air chamber 36 and the vacuum chamber 34 such that the heated air chamber 36 and vacuum chamber 34 are in fluid communication via the plurality of air ports 50.

The fan 46 can be arranged so that when the fan 46 is initiated, the fan 46 causes ambient air to flow into the heated air chamber 36 through the plurality of openings in the air intake section 48, through the fan 46, and over the heating element 44, where the ambient air is heated by the heating element 44. The heated air can gather in the forward portion of the heated air chamber 36. Due to the positive forces generated by the fan 46 in the heated air chamber 36 and the suction force in the vacuum chamber 34, the heated air flows from the heated air chamber 36, through the air ports 50, and into the vacuum chamber 34. The flow of air through the heated air chamber 36 is illustrated by flow lines 52 in FIG. 6.

The vacuum chamber 34 is flared near the hair receiving aperture 38 such that a heated air pocket 54 is formed along the circumference of the vacuum chamber 34 and proximate to the hair receiving aperture 38. The bore of the vacuum chamber 34 is generally round and smooth, and has a diameter that is approximately the same as the inner diameter of the hose 16 connecting the hand-held unit 14 to a vacuum canister 12. The heated air pocket 54 serves as a relief pocket that allows the heated air entering the vacuum chamber 34 to move along the circumference of the vacuum chamber 34 proximate to the hair receiving aperture 38 and, thus, efficiently and effectively interacting and mixing with hair in the vacuum chamber 34. Such a configuration can also direct heated air to move in a direction that is in line with the flow of air due to the vacuum mechanism, which is along the longitudinal length of the vacuum chamber 34. Such an arrangement can further shield the user's scalp from direct contact with the heated air and the flow of air does not pinch hair gathered in the vacuum chamber 84 because the heated air is directed along the length of the hair.

The hand-held unit 14 can be arranged to selectively provide electrical power to the heating element 44 and fan 46 so as to initiate the fan 46 and elevate the temperature of the heating element 44. As the fan 46 is initiated, ambient air moves into the heated air chamber 36, across the heating element 44, and heat is transferred to the air passing over the heating element 44. It will be understood that the amount of energy provided to the heating element 44 and the speed of the fan 46 can be adjusted to control the temperature of the air exiting the heated air chamber 36 into the vacuum chamber 34. The amount of energy provided to the heating element 44 and the speed of the fan 46 can be controlled by a user using one or more switches or dials positioned on a hand-held unit, vacuum canister, or other location on a hair grooming system.

An exemplary method of using disclosed systems and apparatus is hereafter described. A user can dry hair by grasping the hand-held unit 14 by the handle 26 and turning on the vacuum mechanism using the power switch 32. The user can gather a section of wet hair and starting with the free ends of the section of wet hair insert the section of wet hair into the hair receiving aperture 38. The user can continue to insert the section of wet hair until the full length of the section is positioned within the vacuum chamber 34. In one example, the full length of the section of wet hair is positioned within the vacuum chamber 34 once the hand-held unit 14 is in contact with the user's head or scalp. The flow of air into and through the vacuum chamber 34 due to the suction force can facilitate the user's positioning of the section of wet hair into the vacuum chamber 34.

Once excess water is removed from the section of hair, which can occur in a little as a few seconds, the user can move the hand-held unit 14 a short distance away from the user's scalp, and initiate the heating element 44 and fan 46. The heating element 44 and fan 46 can be initiated by a switch or dial located on the hand-held unit 14 or vacuum unit 12. As will be understood, once the heating element 44 and fan 46 are initiated, the fan 46 draws in air through the air intake section 48 and across the heating element 44 to heating the air. Once heated, the air moves through the air ports 50 and flows along the hair in the vacuum chamber 34. The heated air is directed though the vacuum chamber 34 by the suction force created by the vacuum mechanism. The user can selectively move the hand-held unit 14 further to and then closer to the scalp to assist in drying the full length of longer hair. During the drying processes, the direction of air flow through the vacuum chamber 34 is along the length of the hair moving away from the scalp and toward the free ends of the hair.

When this section of hair is at the desired level of dryness or style, the user can switch off the fan 46 and heating element 44 and allowing unheated ambient air to flow along the section of hair, which can seal the cuticles of each strand of hair. Such sealing of the cuticles can be achieved in as little as a few seconds. The hand-held unit 14 can be optionally arranged so that a switch for the heat activation can be a momentary push button switch, an on/off switch, or any switch or input causing the heat to turn on and off as the user desires. The user can repeat the process described herein on additional sections of hair until the user's hair is generally dry. The shape of the vacuum chamber in the embodiment illustrated in FIGS. 1-6 can result in hair that is dry, smooth, and generally straight. It will be understood that to achieve wavy hair, the vacuum chamber can be manufactured to include one or more gradual bends so that when wet hair engages the gradual bend, it takes on the shape of the bend as it is dried. It will be further understood that to achieve curly hair, the vacuum chamber can be manufactured to include one or more tight bends so that when wet hair engages the tight bends, it takes on the shape of the bends as it is dried.

The system includes one or more vacuum relief mechanisms. Vacuum relief mechanisms respond to reduce or relieve the vacuum pressure in the vacuum chamber if the pressure because too high. One circumstance that inadvertently increases the pressure in the vacuum chamber is when the hair receiving aperture is blocked by hair or contact with a user's scalp. In such a circumstance, vacuum relief mechanisms can allow ambient air to enter the flow path from other access points so that the pressure on the user's hair or scalp is not excessive. Vacuum relief mechanisms can be a valve that opens when it senses a certain amount of suction force. The vacuum relief mechanism can be located in the hand-held unit, the hose, or the vacuum canister. In essence, it can be located anywhere on the system where it can be in fluid communication with the flow path. In one example, air intake apertures can function as vacuum relief mechanisms. For example, in embodiments with slots that facilitate a fan drawing air into the heated air chamber, such slots can function as vacuum relief mechanisms. The vacuum relief mechanisms can be adjustable so that a user can control the effective opening of vacuum relief mechanism and, therefore, control the allowable pressure in the flow path. In addition, protrusions or "bumps" can be incorporated into or near the hair receiving aperture so that the hand-held unit cannot be place flush against a user's scalp because the protrusions enable gaps that air can flow through.

The outer housing of a hand-held unit 14 can be arranged to form a vacuum chamber and/or a heated air chamber. In another example, a vacuum chamber and heated air chamber can be formed as separate components that can be assembled into a hand-held unit. In yet another example, a vacuum chamber and heated air chamber can be integrated into one component that is subsequently assembled into a hand-held unit.

In other embodiments, the hand-held unit can be arranged without a fan or heating element. Grooming of hair is accomplished using unheated ambient air moving along the hair due to the suction force created by a vacuum mechanism. In another embodiment, a hand-held unit can be designed without a fan, but includes a heating element. The suction force created by the vacuum mechanism pulls ambient air across a heating element to heat the air before it flows along the length of the hair. Additional features can be incorporated into the hand-held units to facilitate grooming of hair. For example, the vacuum chamber can include various features arranged to control the flow of air through the vacuum chamber to reduce or eliminate tangling or fluttering of hair in the vacuum chamber. FIGS. 7-13 illustrate such features.

Figure 7:
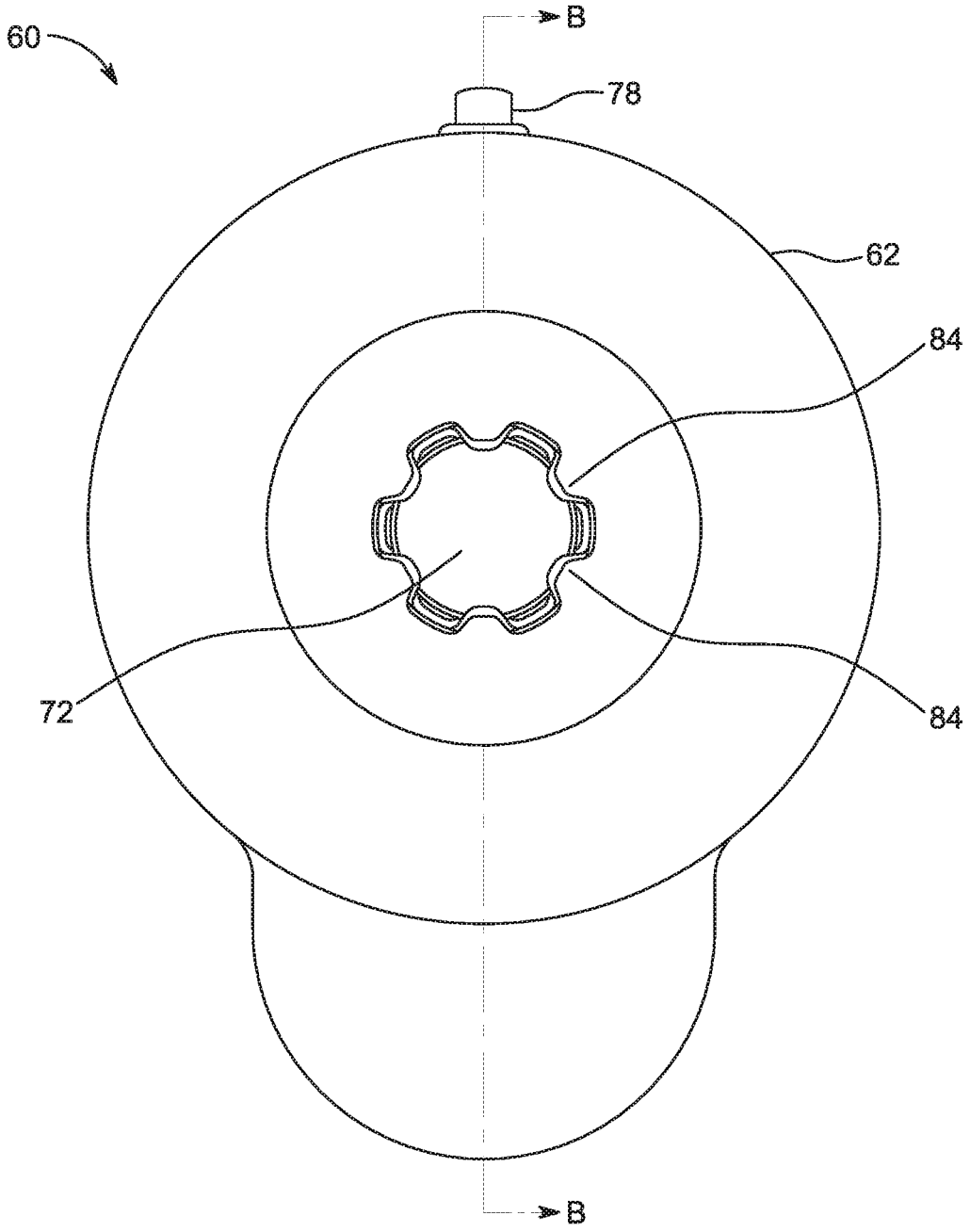
FIG. 7 is a schematic illustration depicting a front elevation view of another hand-held unit for use with a hair grooming system.
Figure 8:
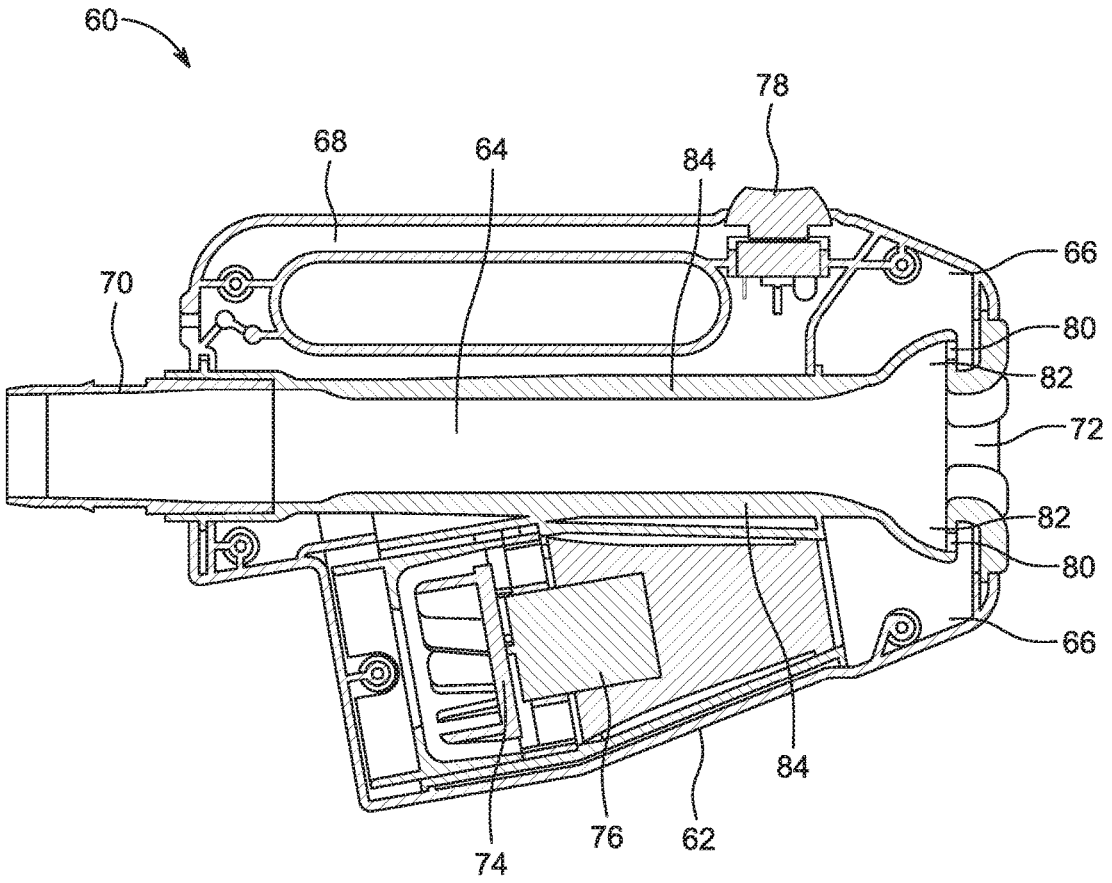
FIG. 8 is a schematic illustration depicting a cross-sectional view of the hand-held unit of FIG. 7 taken along the line B-B of FIG. 7.

FIGS. 7 and 8 illustrated the use of vanes in a vacuum chamber. FIG. 7 is a front elevation view of a hand-held unit 60, and FIG. 8 is a cross-sectional view of the hand-held unit 60 taken along the line B-B of FIG. 7. Similar to prior descriptions, the hand-held unit 60 includes an outer housing 62, a vacuum chamber 64, and a heated air chamber 66 surrounding the vacuum chamber 64, a handle 68, and a hose connector 70. A hair receiving aperture 72 is formed in one end of the outer housing 62. A fan 74 and a heating element 76 are positioned within the heated air chamber 66. A power switch 78 located on the exterior of the outer housing 62 can turn the vacuum mechanism on or off, turn the heating elements 76 and fan 74 on or off, or control the vacuum mechanism, the heating element, and the fan.

The hand-held unit 60 further includes a plurality of air ports 80 positioned between the heated air chamber 66 and the vacuum chamber 64 such that when the fan 74 is initiated, ambient air flows across the heating element 76 and through the air ports 80. Further, the vacuum chamber 64 is flared near the hair receiving aperture 72 such that a heated air pocket 82 is formed along the circumference of the vacuum chamber 64 and proximate to the hair receiving aperture 72. The bore of the vacuum chamber 64 is generally round and smooth and includes a plurality of vanes 84 extending outward from the wall of the vacuum chamber 64 toward the center of the vacuum chamber 64 and extending along the length of the vacuum chamber 64. The vanes 84 form channels along which air can flow. Such channels provide control over the flow of air through the vacuum chamber 64. The vanes 84 and resulting channels can result in a reduction or elimination of turbulent flow and generally promote laminar flow through the vacuum chamber 64. When hair is exposed to turbulent air flow, the hair can rapidly flutter from side-to-side, which can result in damage to the hair, especially to the ends of the hair, due to tangling and other physical interactions. Although six vanes 84 are illustrated in this embodiment, it will be understood that a vacuum chamber can be arranged with more or less than six vanes, and the vanes can be arranged in various shapes.

Figure 9:
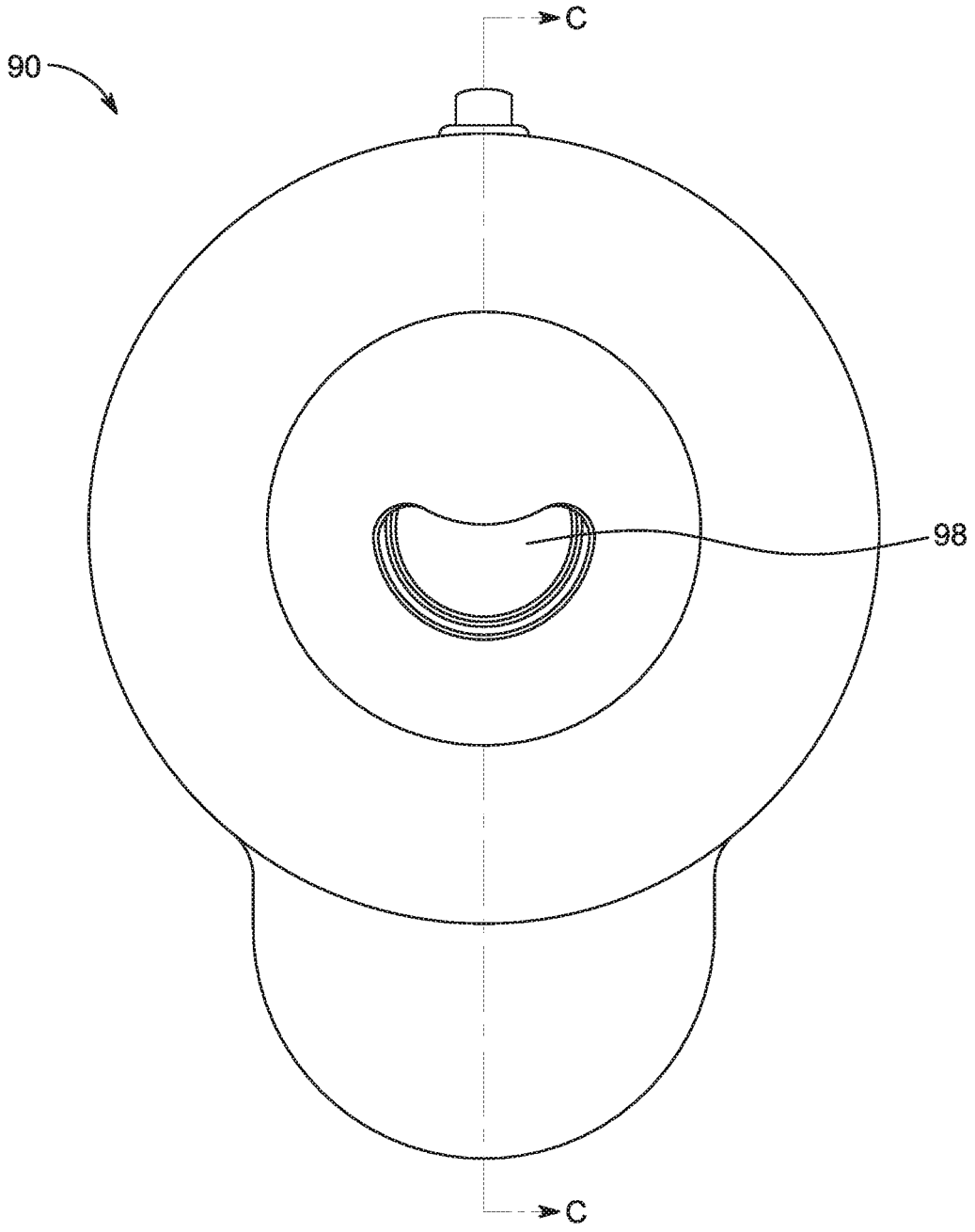
FIG. 9 is a schematic illustration depicting a front elevation view of another hand-held unit for use with a hair grooming system.
Figure 10:
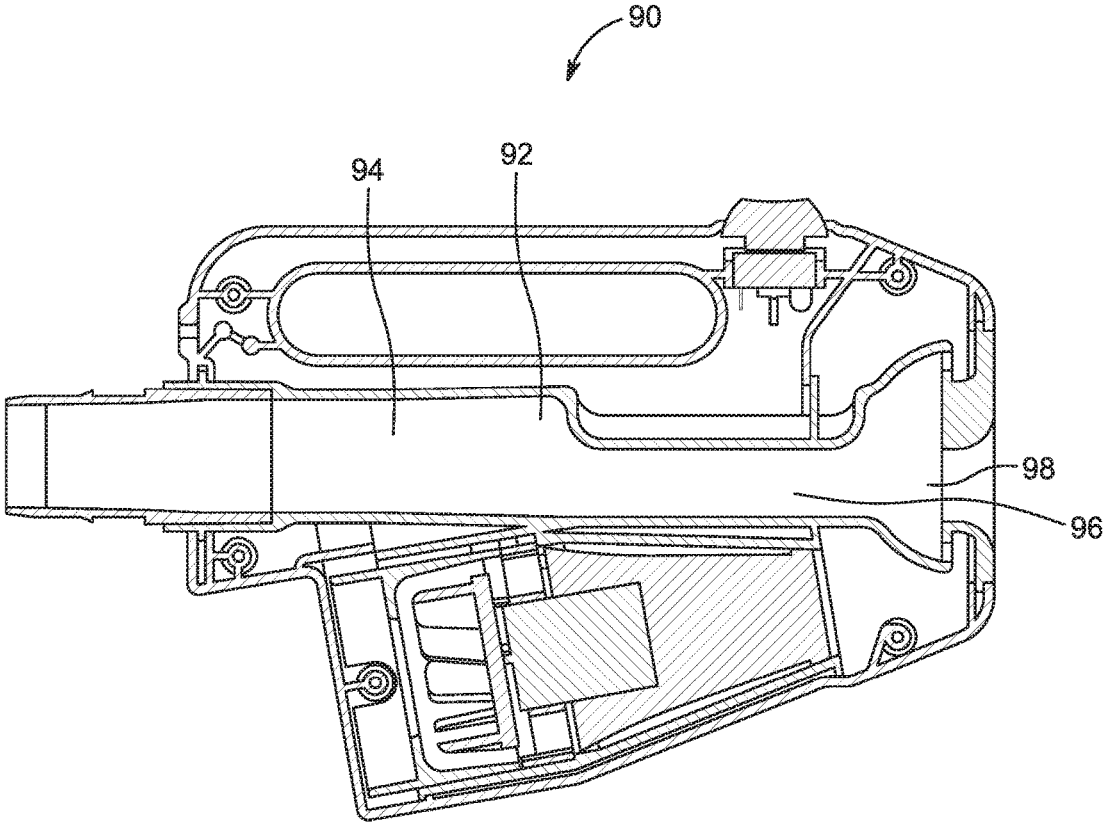
FIG. 10 is a schematic illustration depicting a cross-sectional view of the hand-held unit of FIG. 9 taken along the line C-C of FIG. 9.

FIGS. 9 and 10 illustrated the use of asymmetrical cross-sectional areas and varying cross-sectional areas in a vacuum chamber. FIG. 9 is a front elevation view of a hand-held unit 90, and FIG. 10 is a cross-sectional view of the hand-held unit 90 taken along the line C-C of FIG. 9. The hand-held unit 90 includes many of the features previously discussed. However, the shape of the vacuum chamber 92 includes a first section 94 that is generally circular in cross-section and a second section 96 that is generally a "half-moon" shape in cross-section. As best illustrated in FIG. 10, the section of the vacuum chamber 92 proximate to a hair receiving aperture 98 is half-moon shaped in cross-section and transitions to a circular cross-section as it extends away from hair receiving aperture 98. Such an irregular shape can create air flow that is more uniform across the width of the vacuum chamber 92. Under certain conditions, a uniform cross-section, such as a circle, creates a flow velocity gradient across a vacuum chamber. The flow velocity is lowest along the wall of a circular vacuum chamber and greatest at the longitudinal center of the vacuum chamber. Creating a vacuum chamber with irregular shapes such as a half-moon section or including vanes as previously discussed can affect the flow velocity gradient such that the flow of air is more uniform across the cross-section of the vacuum chamber. It will be understood that in addition to the irregular shapes illustrated herein such as half-moon cross-sections and the addition of vanes, other irregular shapes can be incorporated in vacuum chambers as a feature of systems and apparatus disclosed herein.

The vacuum chamber 92 of FIGS. 9 and 10 also has a varying cross-sectional area along the vacuum chamber. The cross-sectional area of the first section 94 is greater than the cross-sectional area of the second section 96. It will be appreciated that as air flows from the smaller cross-sectional area of the second section 96 to the larger cross-sectional area of the first section 94, the velocity of the air flowing through the vacuum chamber will slow. When the free ends of hair extend into the first section 94, the lower velocity can reduce tangling of the hair and the side-to-side fluttering of the hair.

Figure 11:
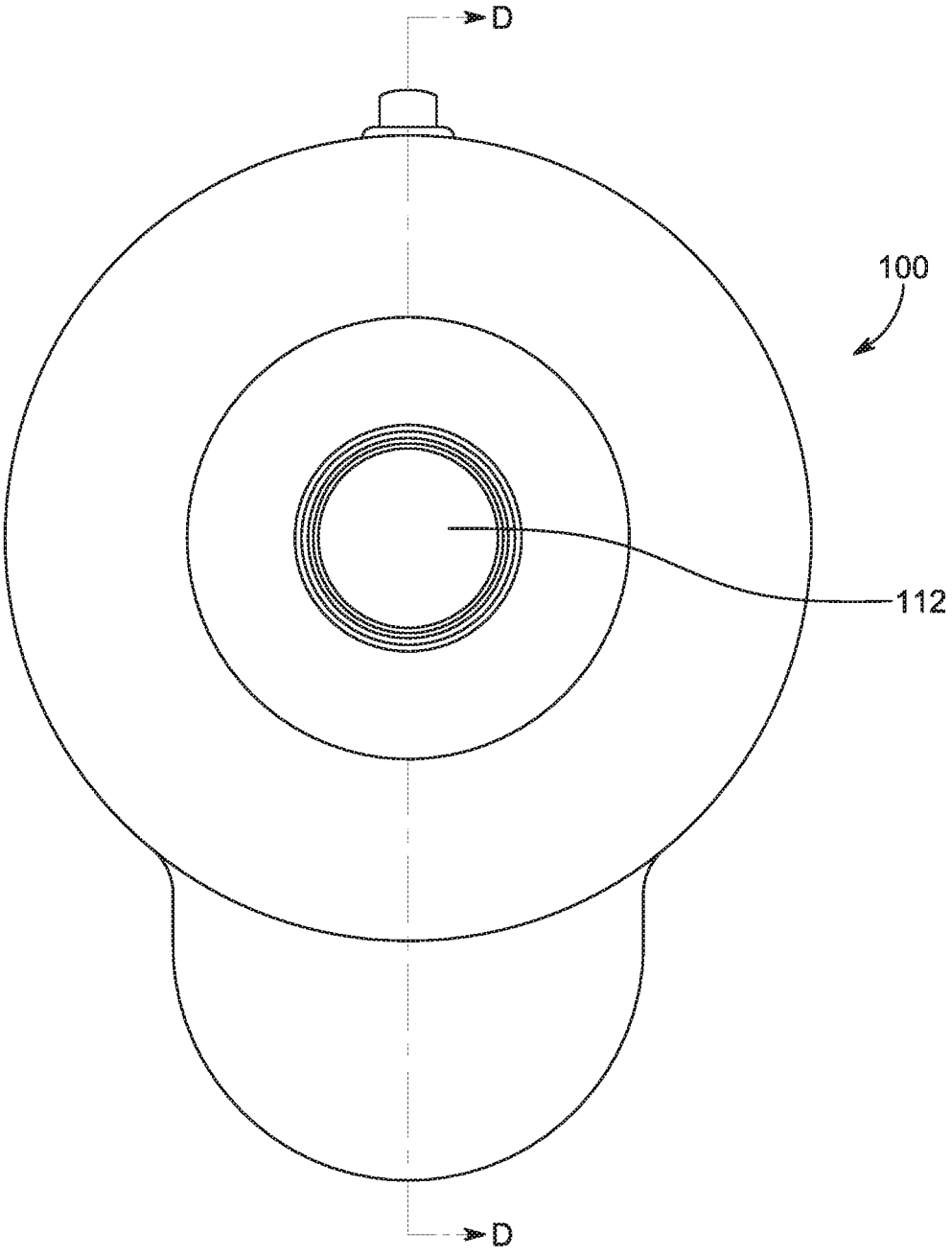
FIG. 11 is a schematic illustration depicting a front elevation view of another hand-held unit for use with a hair grooming system.
Figure 12:
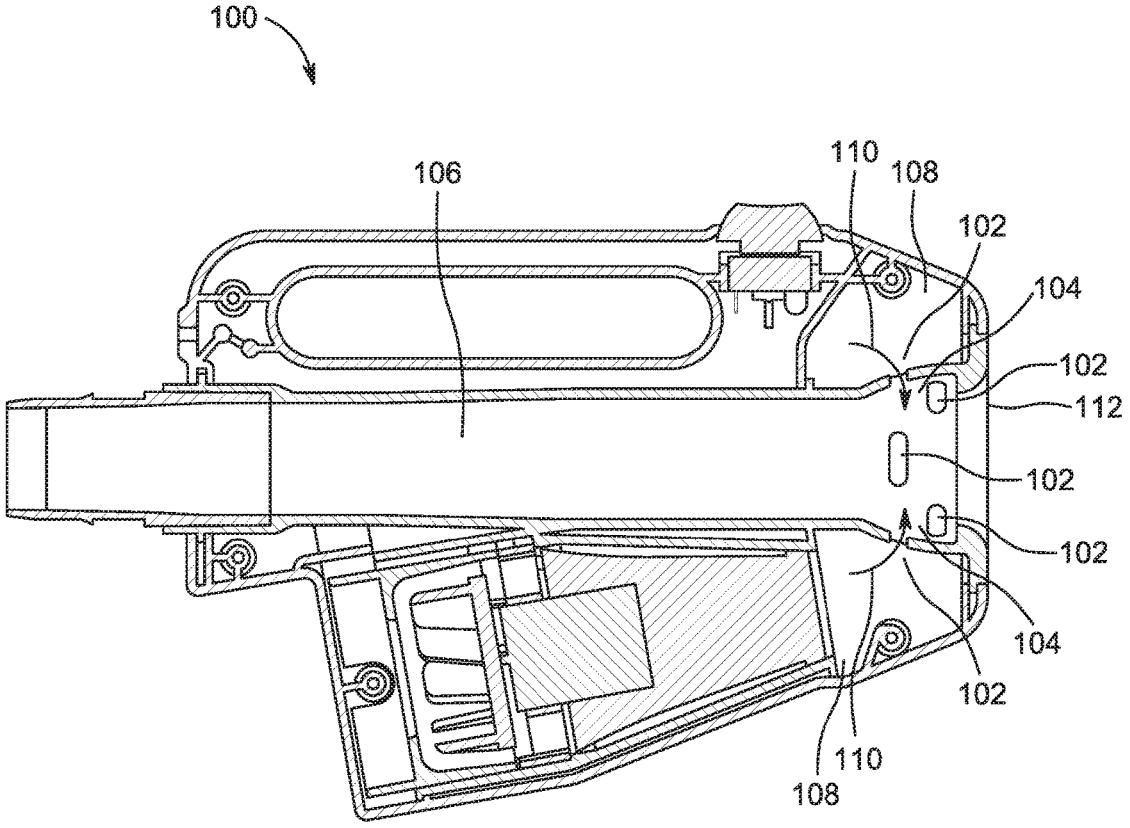
FIG. 12 is a schematic illustration depicting a cross-sectional view of the hand-held unit of FIG. 11 taken along the line D-D of FIG. 11.

FIGS. 11 and 12 illustrated a different arrangement for air ports that channel heated air from the heated air chamber to the vacuum chamber. FIG. 11 is a front elevation view of a hand-held unit 100, and FIG. 12 is a cross-sectional view of the hand-held unit 100 taken along the line D-D of FIG. 11. The hand-held unit 100 includes many of the features previously discussed. However, the position of a plurality of air ports 102 and the formation of a heated air pocket 104 differ from previous disclosed embodiments. The plurality of air ports 102 direct heated air toward the center of the vacuum chamber 106 and onto hair positioned in the vacuum chamber 106. Heated air flows through a heated air chamber 108, through the plurality of air ports 102, and into the vacuum chamber 106 along the flow lines 110. As best illustrated in FIG. 12, there are two rows of air ports 102. The direction of flow out of the air ports 102 results in the hot air generally gathering across the cross-section of the vacuum chamber 106 and proximate to a hair receiving aperture 112. Therefore, a heated air pocket 104 is created across the cross-section of the vacuum chamber 106 and proximate to the hair receiving aperture 112, which provides for the hot air to mix with the hair. The bore of the vacuum chamber 166 is generally round and smooth. Furthermore, the direction of heated air exiting the air ports 102 is directed toward the center of the vacuum chamber 106, which can limit or eliminate instances of the hair pinching near the hair receiving aperture 112.

Figure 13:
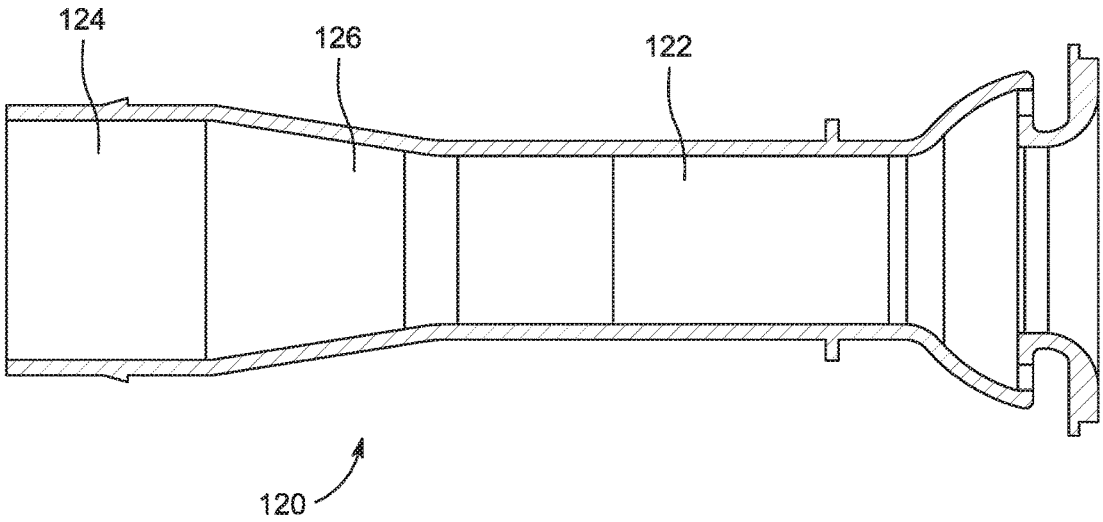
FIG. 13 is a schematic illustration depicting a cross-sectional view of a vacuum chamber for use with hair grooming systems disclosed herein.

FIG. 13 is a cross-sectional view of an exemplary vacuum chamber 120 with a cross-sectional area that varies across the length of the vacuum chamber 120. The vacuum chamber 120 includes a first section 122 with a first diameter, a second section 124 with a second diameter that is greater than the first diameter, and a transition section 126 that transitions from the first diameter to the second diameter. The transition from the smaller first diameter to the greater second diameter reduces the air flow velocity as air moves through the vacuum chamber 120. Such a reduction in air flow velocity can reduce the amount of side-to-side movement of hair, which can reduce tangling and damage to hair groomed in the vacuum chamber 120, particularly the damage to the ends of the strands of hair. In one example, the diameter of the second section 124 is twice that of the first section 122. Such an expansion in the diameter will cause the air flow velocity to be reduced by a factor of 4. Such a reduction will result in less vigorous side-to-side motion of strands of hair, which will result in less damage to the stands of hair.

Figure 14:
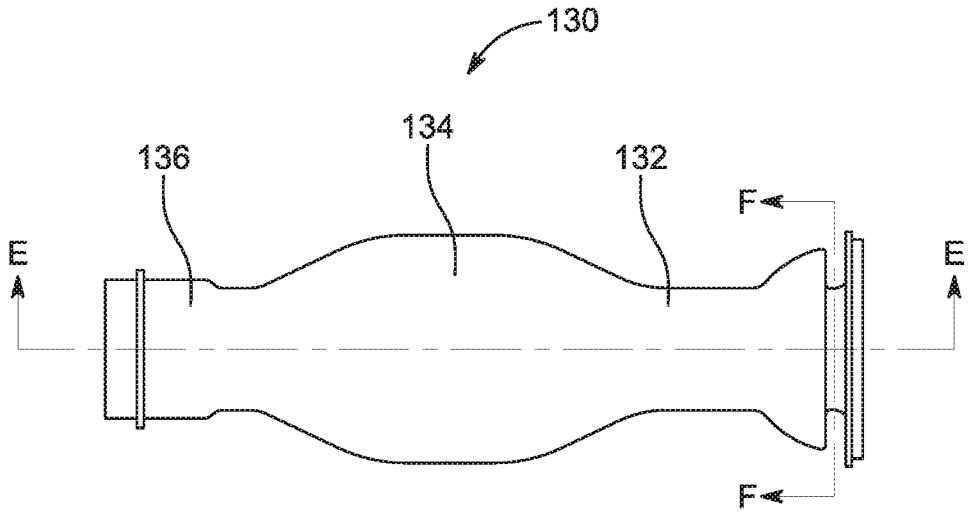
FIG. 14 is a schematic illustration depicting a side view of a vacuum chamber for use with hair grooming systems disclosed herein.
Figure 15:
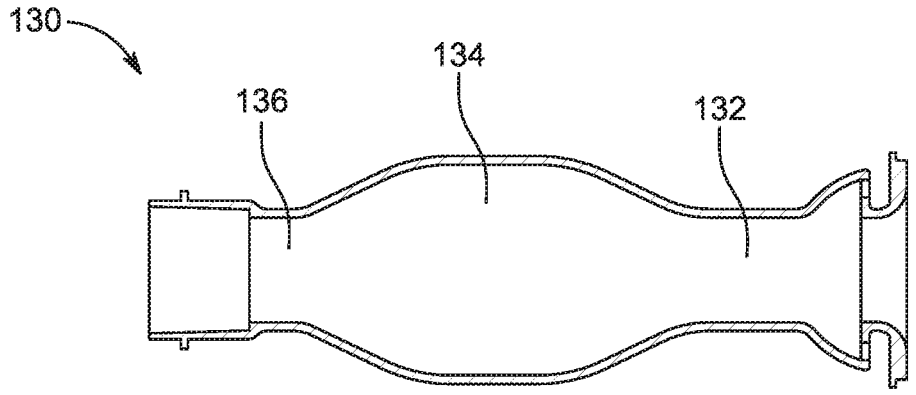
FIG. 15 is a schematic illustration depicting a cross-sectional view of the vacuum chamber of FIG. 14 taken along the line E-E of FIG. 14.
Figure 16:
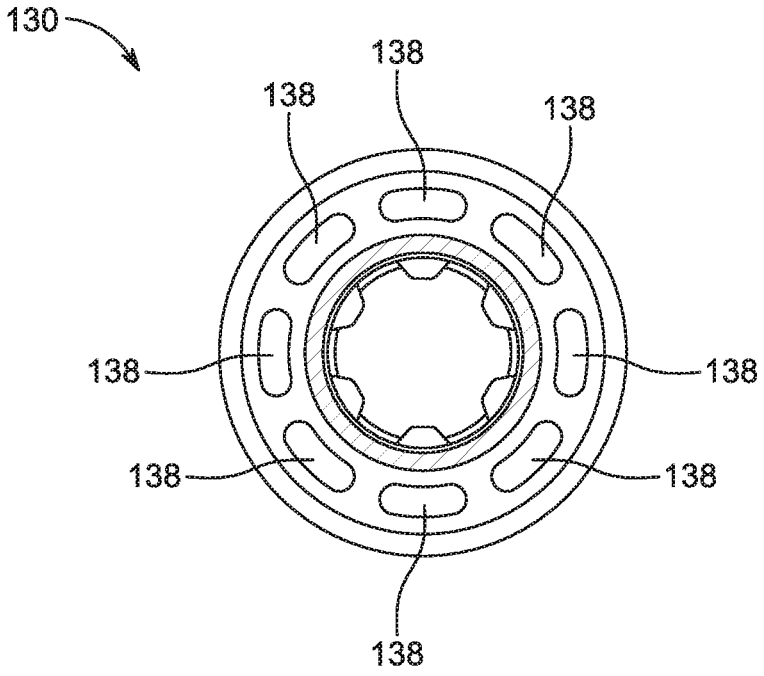
FIG. 16 is a schematic illustration depicting a cross-sectional view of the vacuum chamber of FIG. 14 taken along the line F-F of FIG. 14.
Figure 17:
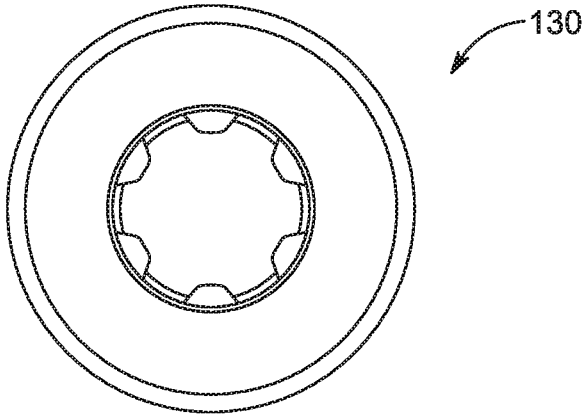
FIG. 17 is a schematic illustration depicting a front elevation view of the vacuum chamber of FIG. 14.

FIGS. 14-17 illustrate another exemplary vacuum chamber 130. FIG. 14 is a side view of the vacuum chamber 130, FIG. 15 is a cross-sectional view taken along the line E-E of FIG. 14, FIG. 16 is a cross-sectional view taken along the line F-F of FIG. 14, and FIG. 17 is a front elevation view of the vacuum chamber 130. The vacuum chamber 130 includes three sections: a first section 132 with a first diameter; a second section 134 with a second diameter that is larger than the first diameter; and a third section 136 with a third diameter, which is smaller than the first and second diameters. There are gradual transitions between the sections. As air flows though the vacuum chamber 130, the flow velocity will slow as air enters the second section 134, and the flow velocity will increase as air enters the third section 136. As illustrated in FIG. 16, a series of air ports 138 provides access to the vacuum chamber 130 for a heated air chamber or other such adjacent chamber. The air ports 138 direct heated air down through the vacuum chamber 130 on a path parallel to the centerline of the vacuum chamber.

Figure 18:
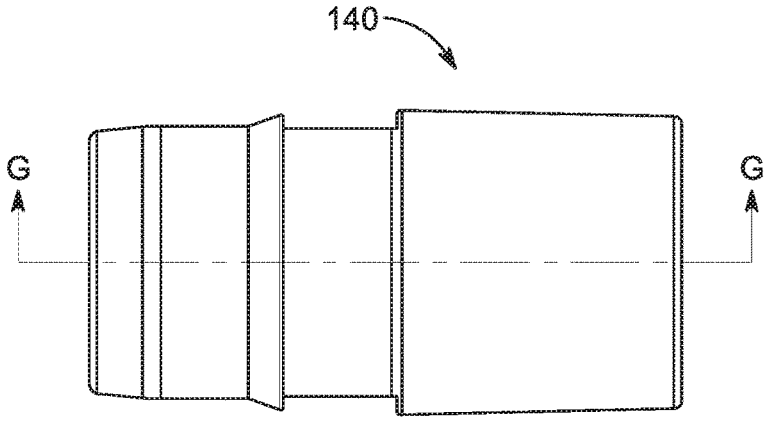
FIG. 18 is a schematic illustration depicting a side view of a flow conditioner for use with hair grooming systems disclosed herein.
Figure 19:
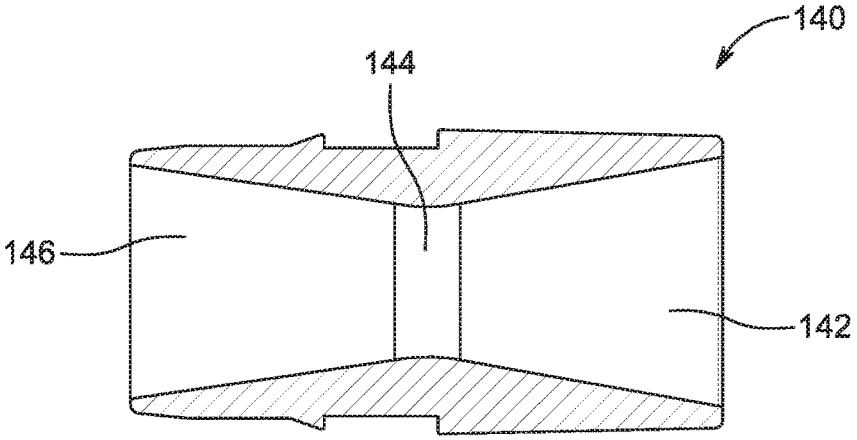
FIG. 19 is a schematic illustration depicting a cross-sectional view of the flow conditioner of FIG. 18 taken along the line G-G of FIG. 18.
Figure 20:
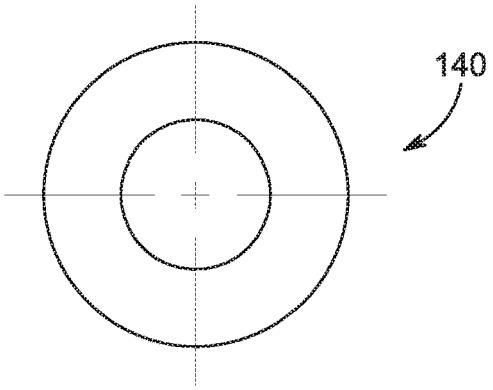
FIG. 20 is a schematic illustration depicting a front elevation view of the flow conditioner of FIG. 18.

Another method of controlling the flow of air through the vacuum chamber is to position a flow conditioner within the flow path. A flow conditioner can be arranged as an insert that can be placed in a vacuum chamber, in the hose, in the vacuum canister, or anywhere else within the flow path. FIGS. 18-20 illustrate one embodiment of a flow conditioner 140. As illustrated in FIG. 20, the bore is generally circular, and as illustrated in FIG. 19, the diameter of the bore varies along the length of the flow conditioner 140. A first section 142 of the flow conditioner begins with a relatively large diameter, which decreases gradually until it reaches about the mid-point of the flow conditioner 140, where it transitions to a relatively short second section 144, which has a constant diameter. The flow conditioner 140 then transitions to a third section 146, which begins with a relatively small diameter that gradually increases through the end of the flow conditioner 140.

Figure 21:
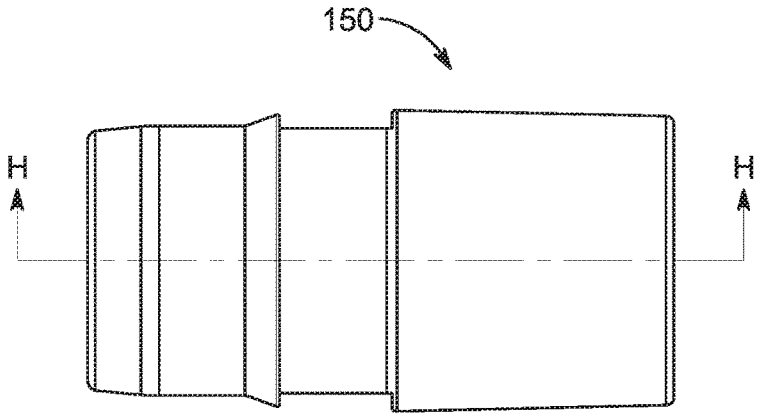
FIG. 21 is a schematic illustration depicting a side view of another flow conditioner for use with hair grooming systems disclosed herein.
Figure 22:
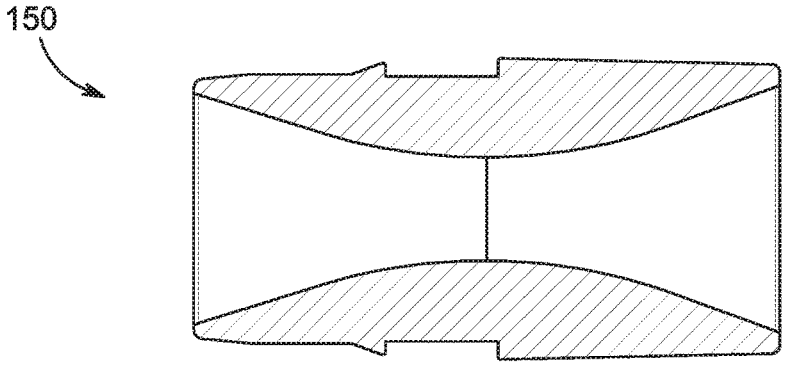
FIG. 22 is a schematic illustration depicting a cross-sectional view of the flow conditioner of FIG. 21 taken along the line H-H of FIG. 21.
Figure 23:
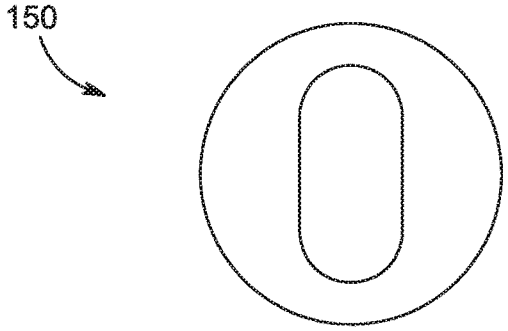
FIG. 23 is a schematic illustration depicting a front elevation view of the flow conditioner of FIG. 21.

FIGS. 21-23 illustrate another embodiment of a flow conditioner 150. As illustrated in FIG. 23, the bore is generally oval, and as illustrated in FIG. 22, the diameter of the bore varies along the length of the flow conditioner 150. A first section 152 of the flow conditioner begins with a relatively large diameter, which decreases gradually until it reaches about the mid-point of the flow conditioner 150, where it transitions to a second section 154, which begins with a relatively small diameter that gradually increases through the end of the flow conditioner 150.

Figure 24:
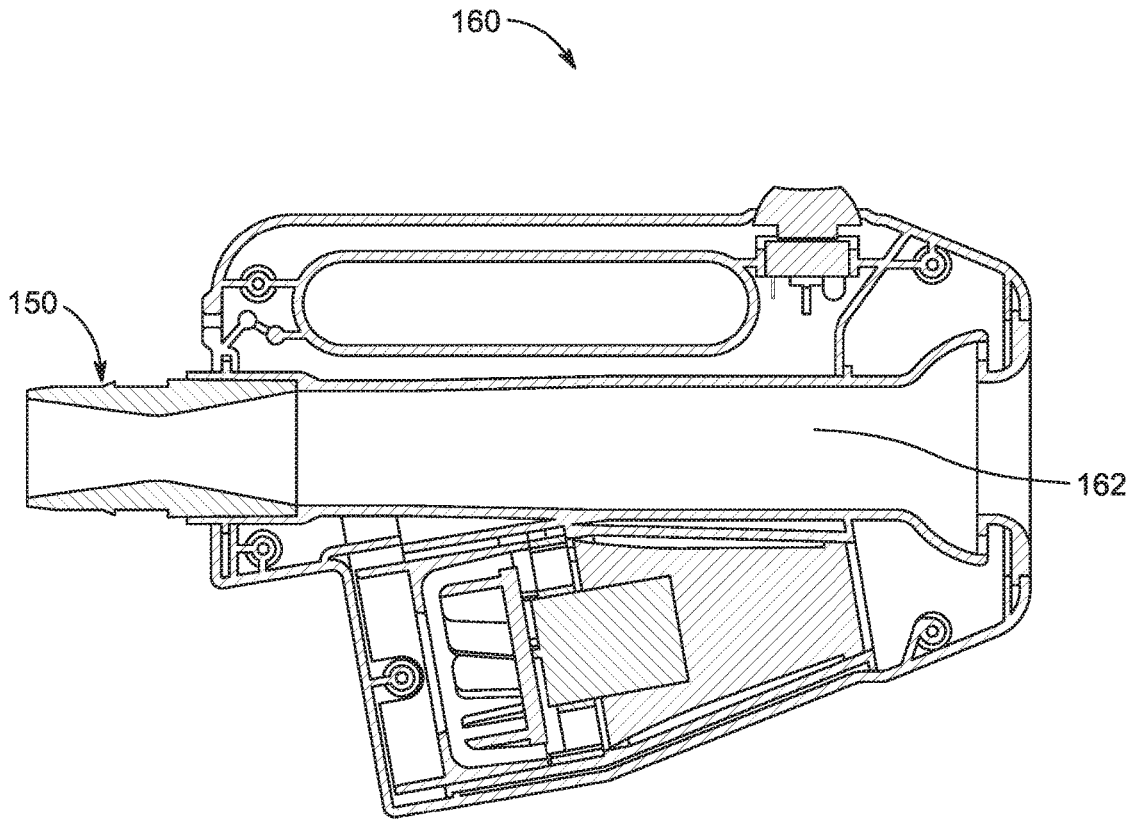
FIG. 24 is a schematic illustration depicting a cross-sectional view of a hand-held unit with a flow conditioner inserted in a vacuum chamber.

FIG. 24 illustrates an exemplary flow conditioner 150 inserted into a hand-held unit 160. The flow conditioner 150 is positioned into the exiting end of the vacuum chamber 162. Conditioning the air flow can decrease the amount of flutter experienced by hair in the vacuum chamber 162. Although the flow conditioner 150 is illustrated as positioned at the exiting end of the vacuum chamber 162, the flow conditioner 150 can be positioned at the entering end of the vacuum chamber 162 or anywhere else in the vacuum chamber. Further, the flow conditioner 150 can be positioned in the hose attached to the hand-held unit 160 or anywhere else in the flow path. Furthermore, a flow conditioner can be integrated or molded into a component of the system. For example, a flow conditioner can be molded as an integral part of the vacuum chamber or as an integral part of the hose.

Figure 25:
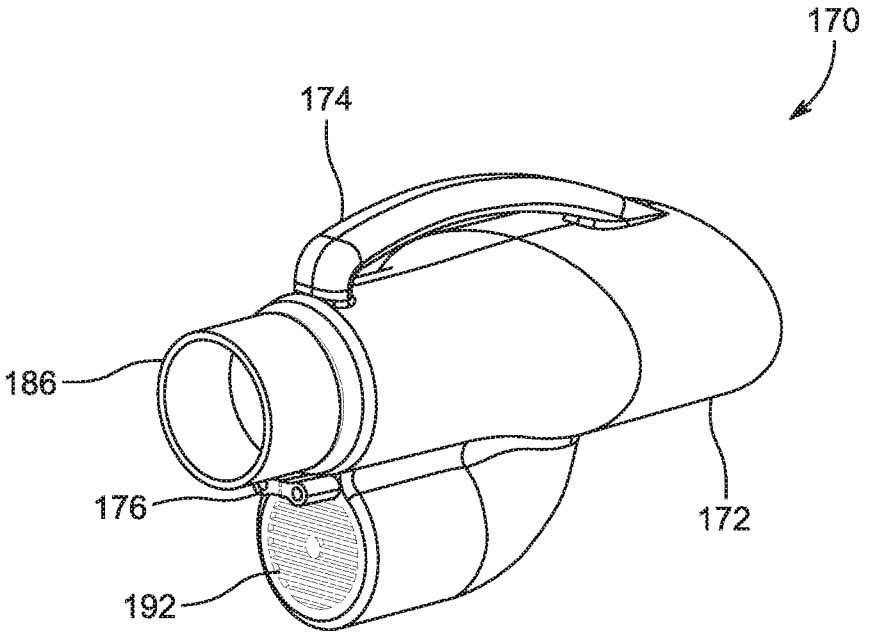
FIG. 25 is a schematic illustration depicting a rear perspective view of a hand-held unit for use with a hair grooming system disclosed herein.
Figure 26:
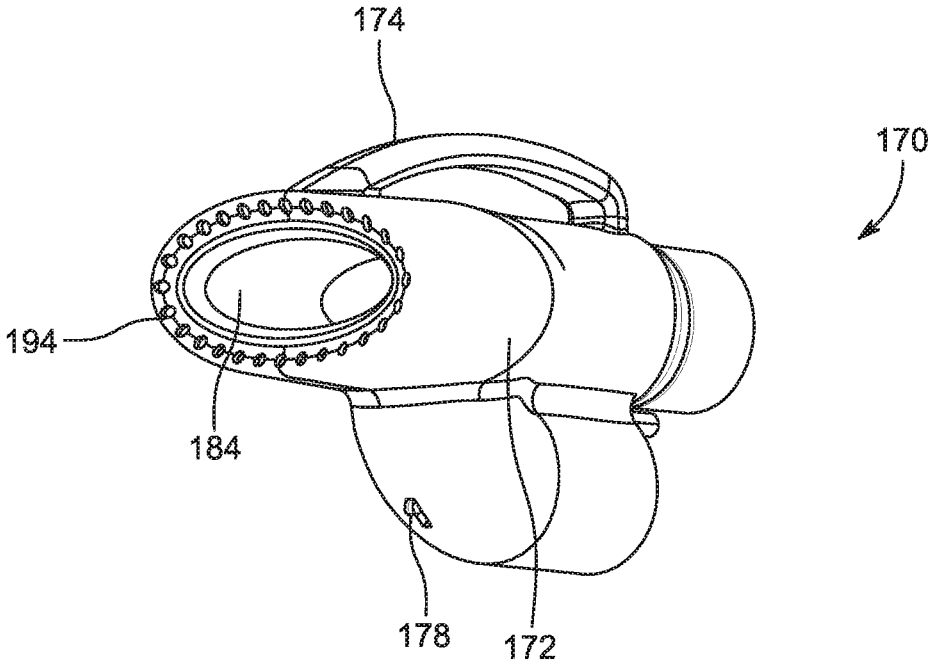
FIG. 26 is a schematic illustration depicting a front perspective view of the hand-held unit of FIG. 25.
Figure 27:
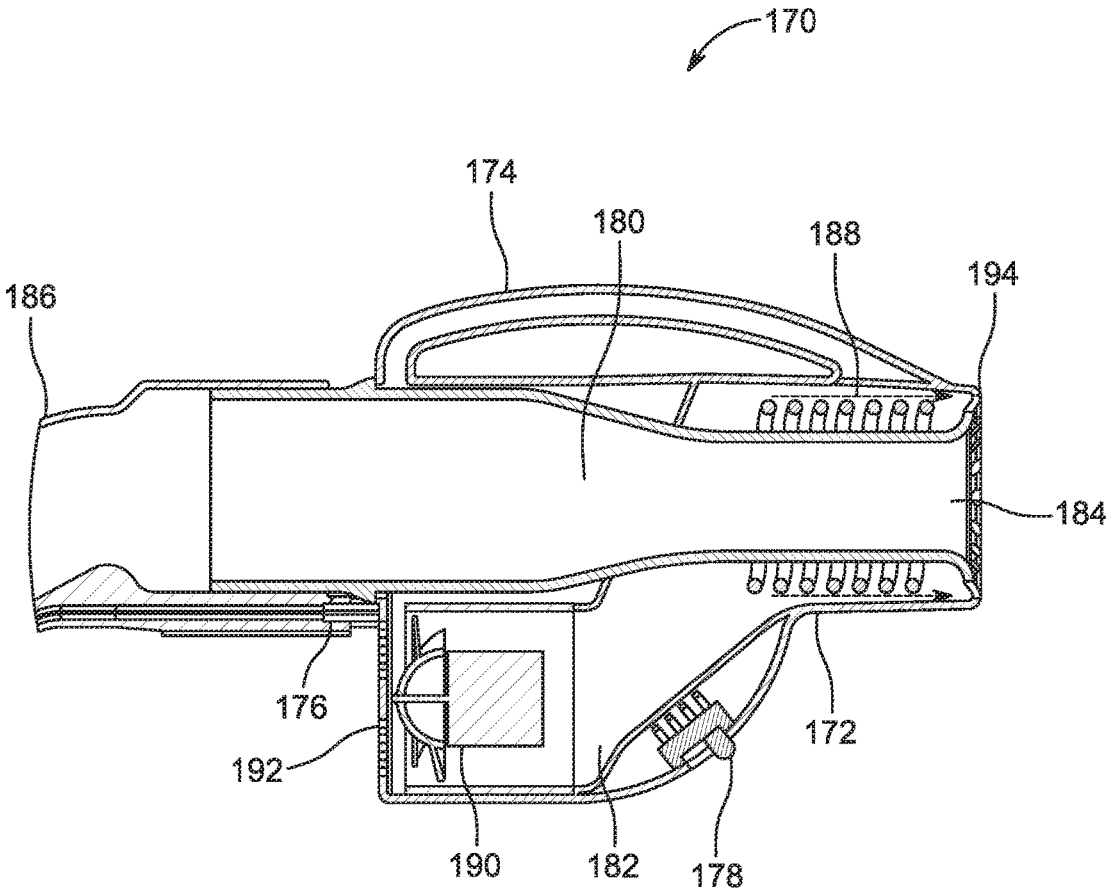
FIG. 27 is a schematic illustration depicting a cross-sectional view of the hand-held unit of FIG. 25.

Another exemplary hand-held unit 170 is illustrated in FIGS. 25-27. The hand-held unit includes an outer housing 172 and a handle 174. The hand-held unit 170 can further include an electrical connector 176 and a power switch 178. A power cable (not shown) can be engaged with the electrical connector 178 to provide electrical power to the hand-held unit 170. The power switch 178 can be conveniently placed on the hand-held unit 170 to facilitate a user of the hand-held unit 170 turning certain functions on and off. Additionally, although a single power switch is illustrated, it will be understood that two or more power switches can be included to facilitate turning on and off various functions and subsystems of the hair grooming system.

The hand-held unit 170 further includes a vacuum chamber 180 and a heated air chamber 182. The general shape of the vacuum chamber 180 as illustrated is oval in cross-section. The vacuum chamber 180 includes a hair receiving aperture 184 and an exit aperture 186. Positioned within the heated air chamber 182 are a series of heating coils 188 and a fan 190. Positioned proximate to the fan 190 is an air intake aperture 192 that forms an opening in the outer housing 172 to provide the fan 190 with access to ambient air. Positioned proximate to the hair receiving aperture 184 are a plurality of air ports 194. The plurality of air ports 194 are positioned in the outer housing 172 along the circumference of the hair receiving aperture 184.

The fan 190 causes ambient air to flow into the heated air chamber 182, over the heating coils 188, and through the air ports 194. The air ports 194 are arranged such that when air exits the heated air chamber 182, the air is channeled to the hair receiving aperture 184, where the suction force from the vacuum chamber 172 can draw the heated air in the vacuum chamber 172 to engage hair positioned in the vacuum chamber 172.

Figure 28:
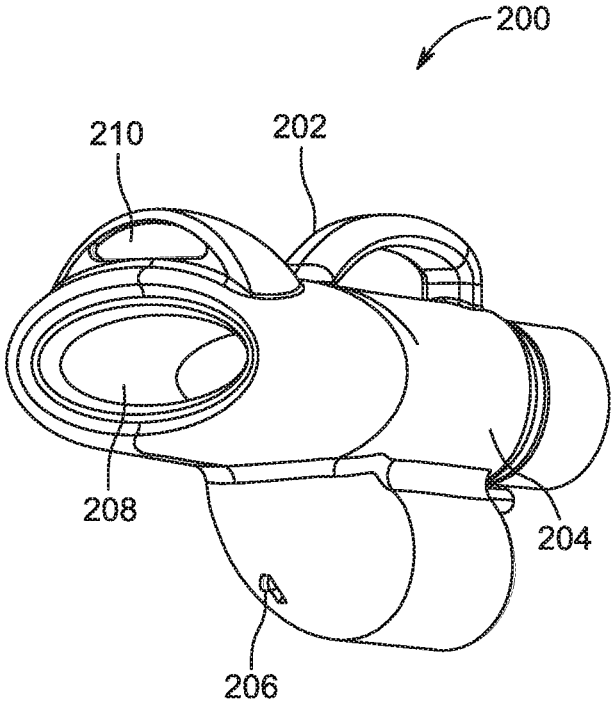
FIG. 28 is a schematic illustration depicting a front perspective view of a hand-held unit for use with a hair grooming system disclosed herein.

FIG. 28 illustrates another embodiment of a hand-held unit 200. Similar to FIGS. 25-27, the hand-held unit 200 includes a handle 202, an outer housing 204, a power switch 206, and a hair receiving aperture 208. In the embodiment of FIG. 28, a heated air chamber and heating elements are positioned in front of the vacuum chamber proximate to the hair receiving aperture 208 and not surrounding the vacuum chamber as described in other embodiments. In such an embodiment, air is heated and applied directly to the hair through a plurality of air ports positioned in the interior wall of the heated air chamber. A fan can be positioned in the heated air chamber to move ambient air past heating elements and onto the hair in the vacuum chamber. Ambient air can be drawn into the hand-held unit through an air intake aperture 210. Alternatively, a fan is not included. Ambient air is drawn into the hand-held unit by the suction force created by the vacuum mechanism. Similar drying effects can be achieved by directing the heated air towards the user's hair as it is being pulled into the vacuum chamber.

We claim:

1. A hair grooming apparatus comprising:

a vacuum mechanism;

a vacuum chamber in fluid communication with the vacuum mechanism, the vacuum chamber comprising:

a first opening positioned at a first end of the vacuum chamber, having a first cross-sectional area, and arranged to accommodate an insertion of a section of hair;

a second opening positioned at a second end of the vacuum chamber opposite the first end of the vacuum chamber;

a wall extending from the first opening to the second opening and defining an interior bore; and an air pocket formed along a section of the interior bore, the section of the interior bore extending from a first location positioned proximate to the first opening and having a second cross-sectional area to a second location positioned between the first location and the second opening and having a third cross-sectional area, wherein the second cross-sectional area is greater than both the first cross-sectional area and the third cross-sectional area.

2. The hair grooming apparatus of claim 1, further comprising:

a vacuum canister, wherein the vacuum mechanism is positioned within the vacuum canister; and a hose positioned between the vacuum canister and the vacuum chamber.

3. The hair grooming apparatus of claims 1, wherein cross-sectional areas of the section of the interior bore varies continuously from the first location to the second location.

4. The hair grooming apparatus of claims 3, wherein the section of the interior bore is generally tapered from the first location to the second location.

5. The hair grooming apparatus of claim 1, further comprising:

a heated air chamber in fluid communication with the vacuum chamber;

a heating element; and a fan configured to blow air over the heating element and into the heated air chamber.

6. The hair grooming apparatus of claim 5, wherein the vacuum chamber, heated air chamber, heating element, and fan are positioned within a hand-held unit.

7. The hair grooming apparatus of claim 6, wherein the vacuum chamber includes at least one aperture positioned proximate to the first opening through which the heated air chamber is in fluid communication with the vacuum chamber.

8. The hair grooming apparatus of claim 6, wherein the heated air chamber at least partially surrounding the vacuum chamber and in fluid communication with vacuum chamber to introduce heated air to the vacuum chamber.

9. The hair grooming apparatus of claim 8, wherein the fluid communication between the heated air chamber and the vacuum chamber is formed by at least one aperture in the wall positioned proximate to the air pocket.

10. The hair grooming apparatus of claim 9, wherein the at least one aperture is a plurality of apertures that are positioned generally equally about a perimeter of the wall.

11. The hair grooming apparatus of claim 8, wherein hot air is introduced to the vacuum chamber at the air pocket.

12. The hair grooming apparatus of claim 11, wherein the vacuum chamber further comprises a front wall generally perpendicular to the wall defining the interior bore located proximate to the air pocket.

13. The hair grooming apparatus of claim 12, further comprising at least one aperture positioned in the front wall to introduce hot air to the vacuum chamber at the air pocket.

14. The hair grooming apparatus of claim 13, wherein the at least one aperture is a plurality of apertures that are positioned generally equally about the front wall.

15. The hair grooming apparatus of claim 14, wherein the plurality of apertures direct an introduction of heated air to the vacuum chamber at the air pocket in a direction substantially parallel to a flow of vacuum air through the vacuum chamber.

16. The hair grooming apparatus of claim 5, further comprising at least one vane extending inward into the interior bore of the vacuum chamber from the wall.

17. The hair grooming apparatus of claim 16, wherein the at least one vane further extends along a length of the wall of the vacuum chamber.

18. The hair grooming apparatus of claim 5, wherein a plurality of vanes extending inward into the interior bore of the vacuum chamber from the wall and further extending along a length of the wall of the vacuum chamber.

19. The hair grooming apparatus of claim 18, wherein the plurality of vanes are arranged equally along an inner circumference of the vacuum chamber.

20. The hair grooming apparatus of claim 1, further comprising a flow conditioner.

21. The hair grooming apparatus of claim 20, wherein the flow conditioner is a separate component inserted into the vacuum chamber.

22. The hair grooming apparatus of claim 20, wherein the flow conditioner is integrally formed into the vacuum chamber.

23. A hair grooming apparatus comprising:

a vacuum mechanism;

a vacuum chamber in fluid communication with the vacuum mechanism, the vacuum chamber comprising:

a first opening arranged to accommodate an insertion of a section of hair; and a second opening opposite the first opening; and a flow conditioner associated with the vacuum chamber, the flow conditioner having a variable cross-section, wherein the flow conditioner includes a first section with a cross-sectional area decreasing from a first end of the flow conditioner towards a middle of the flow conditioner and a second section with a cross-sectional area increasing from the middle of the flow conditioner towards a second and opposite end of the flow conditioner.

24. The hair grooming apparatus of claim 23, wherein the decrease cross-sectional area and increase in cross-sectional area is both linear.

25. The hair grooming apparatus of claim 23, wherein the decrease cross-sectional area and increase in cross-sectional area is both nonlinear.

26. The hair grooming apparatus of claim 23, wherein the first end of the flow conditioner is coupled to the second opening of the vacuum chamber.

27. The hair grooming apparatus of claim 23, wherein the flow conditioner is a separate component inserted at least partially into the second opening of the vacuum chamber.

28. The hair grooming apparatus of claim 23, wherein the flow conditioner is integrally formed into the vacuum chamber proximate to the second opening.

29. The hair grooming apparatus of claim 23, further comprising:

a heated air chamber in fluid communication with the vacuum chamber;

a heating element; and a fan configured to blow air over the heating element and into the heated air chamber.

30. The hair grooming apparatus of claim 29, wherein the vacuum chamber, flow conditioner, heated air chamber, heating element, and fan are positioned within a hand-held unit.

* * * * *